US010156138B2

(12) United States Patent
Irani et al.

(10) Patent No.: US 10,156,138 B2
(45) Date of Patent: Dec. 18, 2018

(54) SYSTEM AND METHOD FOR COLLECTING A REPRESENTATIVE FORMATION FLUID DURING DOWNHOLE TESTING OPERATIONS

(71) Applicant: Halliburton Energy Services, Inc., Houston, TX (US)

(72) Inventors: Cyrus A. Irani, Houston, TX (US); B. Raghava Reddy, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 456 days.

(21) Appl. No.: 14/759,151

(22) PCT Filed: Jan. 3, 2013

(86) PCT No.: PCT/US2013/020034
§ 371 (c)(1),
(2) Date: Jul. 2, 2015

(87) PCT Pub. No.: WO2014/107146
PCT Pub. Date: Jul. 10, 2014

(65) Prior Publication Data

US 2015/0337656 A1 Nov. 26, 2015

(51) Int. Cl.
*E21B 49/10* (2006.01)
*E21B 49/08* (2006.01)

(52) U.S. Cl.
CPC ..... *E21B 49/10* (2013.01); *E21B 49/08* (2013.01)

(58) Field of Classification Search
CPC ..... E21B 49/10
See application file for complete search history.

(56) References Cited

U.S. PATENT DOCUMENTS

| | | | |
|---|---|---|---|
| 5,271,474 | A | 12/1993 | Nishimoto et al. |
| 5,514,645 | A | 5/1996 | McCabe et al. |
| 6,147,034 | A | 11/2000 | Jones et al. |
| 7,128,144 | B2 | 10/2006 | Fox et al. |
| 7,260,985 | B2 | 8/2007 | Gilbert et al. |
| 7,328,744 | B2 | 2/2008 | Taylor et al. |
| 7,584,655 | B2 | 9/2009 | Van Zuilekom et al. |
| 7,650,937 | B2 | 6/2010 | Fox et al. |

(Continued)

FOREIGN PATENT DOCUMENTS

CN 202250059 U 5/2012

OTHER PUBLICATIONS

Extended European Search Report issued in corresponding application No. EP 13870314.5, dated Aug. 30, 2016, 7 pgs.

(Continued)

*Primary Examiner* — Kipp C Wallace
(74) *Attorney, Agent, or Firm* — Chamberlain Hrdlicka

(57) ABSTRACT

A method for collecting a formation fluid for testing includes introducing a formation sample tool having a first port and a second port into a wellbore. A first fluid is injected through the first port into the formation to clear a sample passage and allow access to uncontaminated formation fluid. A second fluid is injected through the second port into the formation to provide a barrier adjacent to or around the sample passage. A sample of the uncontaminated formation fluid is removed from the formation through the first port.

18 Claims, 12 Drawing Sheets

(56) References Cited

U.S. PATENT DOCUMENTS

| | | | | |
|---|---|---|---|---|
| 7,759,943 | B2 | 7/2010 | Homan et al. | |
| 7,841,402 | B2 | 11/2010 | Georgi et al. | |
| 8,119,575 | B2 | 2/2012 | Taylor et al. | |
| 9,284,837 | B2 * | 3/2016 | Proett | E21B 49/10 |
| 2004/0173351 | A1 | 9/2004 | Fox et al. | |
| 2006/0076132 | A1 | 4/2006 | Nold, III et al. | |
| 2007/0151727 | A1 | 7/2007 | Tao et al. | |
| 2007/0209793 | A1 | 9/2007 | Nold, III et al. | |
| 2008/0121934 | A1 | 5/2008 | Tarvin | |
| 2008/0125973 | A1 * | 5/2008 | Sherwood | E21B 49/10 702/11 |
| 2009/0151937 | A1 | 6/2009 | Goodwin | |
| 2009/0255671 | A1 | 10/2009 | Georgi et al. | |
| 2009/0262603 | A1 | 10/2009 | Hurley et al. | |
| 2009/0283266 | A1 | 11/2009 | Nold, III et al. | |
| 2010/0089583 | A1 | 4/2010 | Xu et al. | |
| 2010/0116494 | A1 | 5/2010 | Fox et al. | |
| 2010/0132940 | A1 | 6/2010 | Proett et al. | |
| 2010/0200228 | A1 | 8/2010 | Villareal et al. | |
| 2010/0218943 | A1 | 9/2010 | Nold, III et al. | |
| 2011/0139448 | A1 | 6/2011 | Ciglenec et al. | |
| 2011/0162836 | A1 * | 7/2011 | Church | E21B 49/10 166/264 |
| 2013/0284436 | A1 * | 10/2013 | Besijn | E21B 33/12 166/277 |

OTHER PUBLICATIONS

International Search Report issued in corresponding application No. PCT/2013/020034 dated Sep. 16, 2013, 4 pgs.

Kabir et al., SPE 72119: "Chemical Water & Gas Shutoff Technology—An Overview," Society of Petroleum Engineers, 2001: pp. 1-14.

* cited by examiner

SYSTEM AND METHOD FOR COLLECTING A REPRESENTATIVE FORMATION FLUID DURING DOWNHOLE TESTING OPERATIONS

BACKGROUND

1. Field of the Invention

The present disclosure relates generally to the recovery of subterranean deposits and more specifically to methods and systems for sampling non-contaminated or representative hydrocarbons within a well.

2. Description of Related Art

Wells are drilled at various depths to access and produce oil, gas, minerals, and other naturally-occurring deposits from subterranean geological formations. The drilling of a well is typically accomplished with a drill bit that is rotated within the well to advance the well by removing topsoil, sand, clay, limestone, calcites, dolomites, or other materials. The drill bit is typically attached to a drill string that may be rotated to drive the drill bit and within which drilling fluid, referred to as "drilling mud" or "mud", may be delivered downhole. The drilling mud is used to cool and lubricate the drill bit and downhole equipment and is also used to transport any rock fragments or other cuttings to the surface of the well.

As wells are established it is often useful to obtain information about the well and the geological formations through which the well passes. Information gathering is typically performed using tools that are delivered downhole by wireline or alternatively tools that are coupled to or integrated into the drill string. Wireline-delivered tools are suspended from a wireline that is electrically connected to control and logging equipment at the surface of the well. The tools may be deployed by first removing the drill string and then lowering the wireline and tools to an area of interest within the formation. This type of testing and measurement is often referred to as "wireline formation testing (WFT)." The tools associated with WFT may be used to measure pressure and temperature of formation and wellbore fluids.

Instead of wireline deployment, measurement tools are sometime coupled to or integrated with the drill string. In these situations, the added expense and time of removing the drill string prior to measurement of important formation properties is avoided. This process of "measurement while drilling (MWD)" uses measurement tools to determine formation and wellbore temperatures and pressures, as well as the trajectory of the drill bit. The process of "logging while drilling (LWD)" uses tools to determine additional formation properties such as permeability, porosity, resistivity, and other properties. The information obtained by MWD and LWD allow operators to make real-time decisions and changes to ongoing drilling operations.

Collecting a representative sample of formation or reservoir fluids (typically hydrocarbons) is often desired to further evaluate drilling operations and production potential. However, formation fluids near the wellbore are often contaminated by drilling mud and other non-formation-originating fluids injected into the well during drilling operations. These contaminating fluids seep into the formation adjacent the wellbore and provide an impediment to collecting an uncontaminated sample of formation fluid.

SUMMARY

The problems presented by existing systems and methods for sampling formation fluids within a well are solved by the systems and methods of the illustrative embodiments described herein. In one embodiment, a method for collecting a formation fluid from a formation for testing includes introducing a formation sample tool into a wellbore. The formation sample tool includes at least a first port and a second port. A first fluid is injected through the first port into the formation to clear a sample passage allowing access to uncontaminated formation fluid. A second fluid is injected through the second port into the formation to provide a barrier adjacent to or around the sample passage. A sample of the uncontaminated formation fluid is collected from the formation through the first port.

In another embodiment, a system for collecting a formation fluid for testing is provided. The system includes a formation sample tool positionable within a wellbore. The formation sample tool includes a first aperture and a second aperture, and the first and second apertures are capable of being positioned in fluid communication with a formation. A first fluid source is in fluid communication with the first aperture, and a second fluid source is in fluid communication with the second aperture. Formation fluid is collected through the first aperture.

In another embodiment, a system for collecting a formation fluid for testing includes a formation sample tool positionable within a wellbore. The formation sample tool includes at least one port positioned in sealing engagement with the wellbore. A first fluid source is in fluid communication with the at least one port to deliver a first fluid to the formation, and a second fluid source is in fluid communication with the at least one port to deliver a second fluid to the formation after delivery of the first fluid. Formation fluid is collected through the at least one port following delivery of the first and second fluids.

In yet another embodiment, a method for collecting a formation fluid for testing includes introducing a formation sample tool into a wellbore, the formation sample tool having at least one port. A first fluid is injected through the at least one port into the formation to clear a sample passage allowing access to uncontaminated formation fluid. A second fluid is injected through the at least one port into the formation to provide a barrier adjacent to or around the sample passage. A sample of the uncontaminated formation fluid is removed from the formation through the at least one port.

In still another embodiment, a formation sample tool includes a base and a pad coupled to the base. The pad includes a raised shoulder with a surface adapted to contact a surface of a wellbore. A first aperture and a second aperture extend through the base and the pad. The second aperture includes a pair of laterally-spaced apertures, and the first aperture is positioned between the pair of laterally-spaced apertures.

In another embodiment, a formation sample tool includes a base and a pad coupled to the base. The pad includes a raised shoulder with a surface adapted to contact a surface of a wellbore. The raised shoulder of the pad defines a first cavity, and a sealing member defines a second cavity. The sealing member includes a sealing surface adapted to contact the surface of the wellbore. A first aperture extends through the base and the pad, and the first aperture fluidly communicates with the second cavity. A second aperture extends through the base and the pad, and the second aperture fluidly communicates with the first cavity.

In another embodiment, a gellable composition for use with any of the methods, systems, or formation sample tools described herein includes an organophosphate ester or diester and metal salt such as aluminum (III) or iron (III) or any polyvalent metal ion salts that are complexed with an organic amine in an oxygenated solvent.

In still another embodiment, a gellable composition for use with any of the methods, systems, or formation sample tools described herein includes block polymers comprising a hydrophobic polymer block and a hydrophilic polymer block.

In yet another embodiment, a gellable composition for use with any of the methods, systems, or formation sample tools described herein includes a gellable component and a gel-time-controlling agent mixed or contacted with the gellable component to form a gelled portion with a higher viscosity than an original viscosity of the gellable component.

In another embodiment, a gellable composition for use with any of the methods, systems, or formation sample tools described herein includes a gellable component that has a predefined gel time and a gel-time-controlling agent. The gel-time-controlling agent includes a component that retards or extends the gel time of the gellable composition in an area of contact between the gellable component and the gel-time controlling agent.

In another embodiment, a gellable composition for use with any of the methods, systems, or formation sample tools described herein includes a gellable component that has a predefined gel time and a gel-time-controlling agent comprising a gelation inhibitor that prevents gelation of the gellable composition in an area of contact between the gellable component and the gel-time controlling agent.

In another embodiment, a gellable composition for use with any of the methods, systems, or formation sample tools described herein includes a gellable component that gels when placed in contact with a hydrocarbon.

Other objects, features, and advantages of the invention will become apparent with reference to the drawings, detailed description, and claims that follow.

DETAILED DESCRIPTION OF ILLUSTRATIVE EMBODIMENTS

Figure 1A:
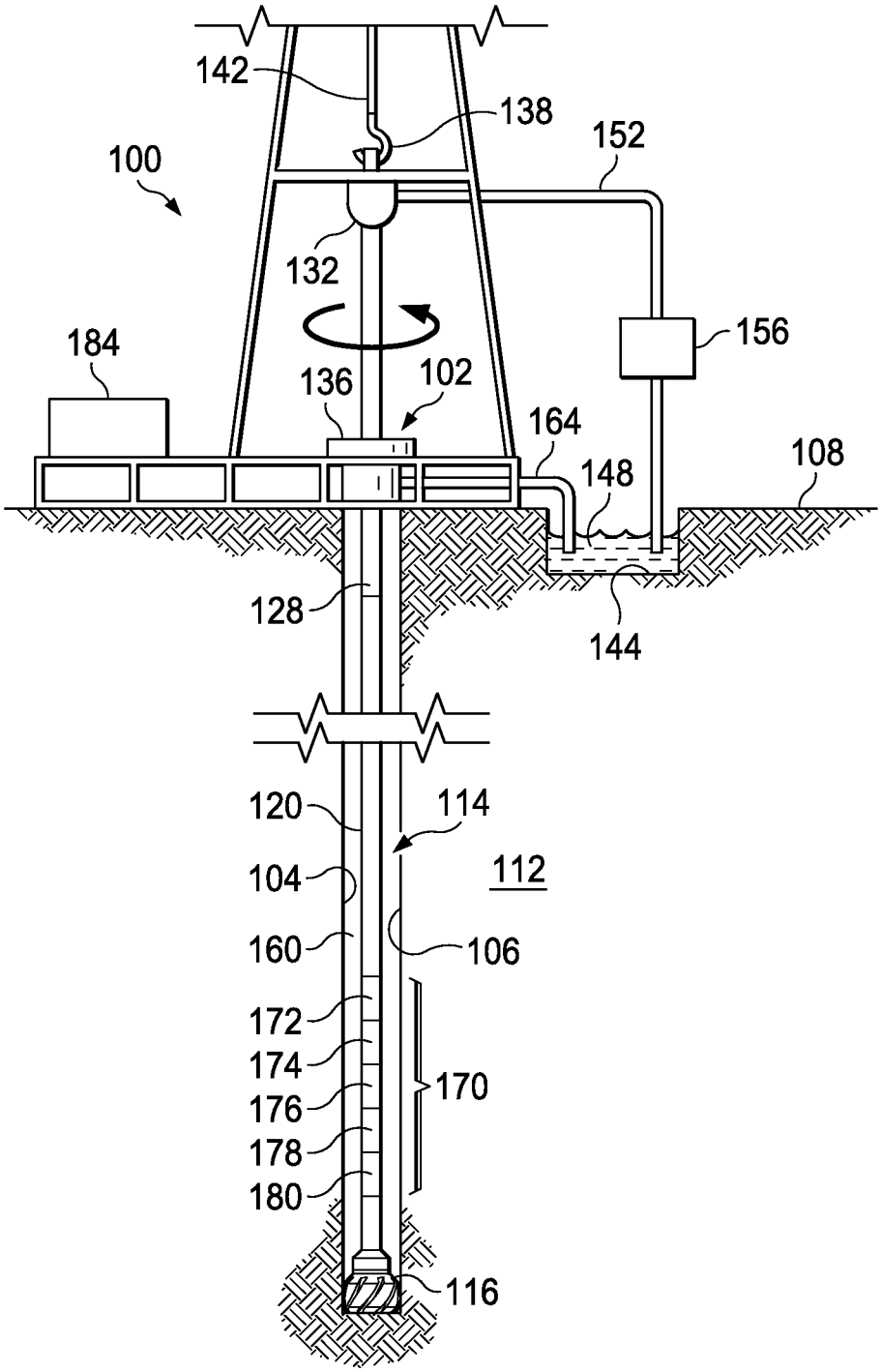
FIG. 1A illustrates a schematic view of a well in which a formation sampling system according to an illustrative embodiment of invention is deployed in an LWD assembly.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The systems and methods described herein provide sampling of formation fluid from wells either during or after drilling operations. Formation sample tools and systems are described that allow uncontaminated formation fluid to be collected from the formation and either tested or stored for later testing. The formation sample tools described herein may vary in design but typically include a sealing pad and one or more apertures or ports passing through the sealing pad. As explained in more detail herein, the one or more apertures or ports may be fluidly connected to at least a first and a second fluid source. One of the fluid sources provides a non-contaminating or non-gelling fluid to the formation to create a clean pathway for collection of uncontaminated formation fluids. A second of the fluid sources provides a gellable composition or other sealing fluid to create a barrier around or adjacent to the clean pathway, thereby preventing contaminated formation fluids adjacent the clean pathway from entering the pathway. The fluids provided by the fluid sources may be delivered to the formation either simultaneously or sequentially.

The illustrative embodiments described in the following disclosure relate to evaluation of a formation through which a well passes. The formation sampling tools, systems and methods described herein may be used with any of the various techniques employed for evaluating formations including, without limitation, wireline formation testing (WFT), measurement while drilling (MWD), and logging while drilling (LWD). The various tools and sampling units described herein may be delivered downhole as part of a wireline-delivered downhole assembly or as a part of a drill string. It should be apparent given the benefit of this disclosure that the apparatuses and methods have applications in downhole operations other than drilling and that drilling is not necessary to practice the embodiments of the invention disclosed herein.

As used herein, the phrases "hydraulically coupled," "hydraulically connected," "in hydraulic communication," "fluidly coupled," "fluidly connected," and "in fluid communication" refer to a form of coupling, connection, or communication related to fluids, and the corresponding flows or pressures associated with these fluids. In some embodiments, a hydraulic coupling, connection, or communication between two components describes components that are associated in such a way that fluid pressure may be transmitted between or among the components. Reference to a fluid coupling, connection, or communication between two components describes components that are associated in such a way that a fluid can flow between or among the components. Hydraulically coupled, connected, or communicating components may include certain arrangements where fluid does not flow between the components, but fluid pressure may nonetheless be transmitted such as via a diaphragm or piston.

Figure 1B:
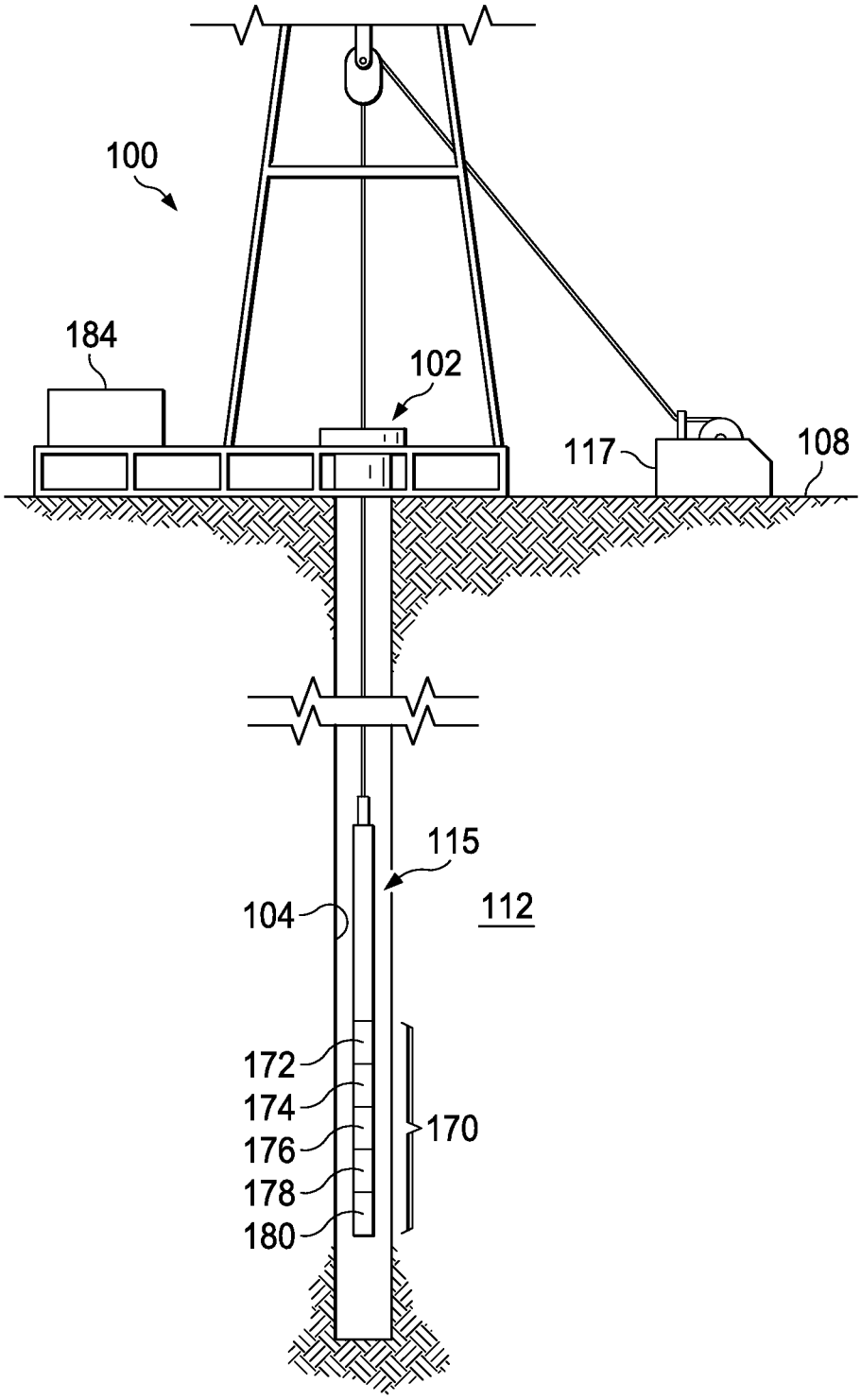
FIG. 1B illustrates a schematic view of a well in which the formation sampling system of FIG. 1A is deployed in a wireline or WFT assembly.
Figure 1C:
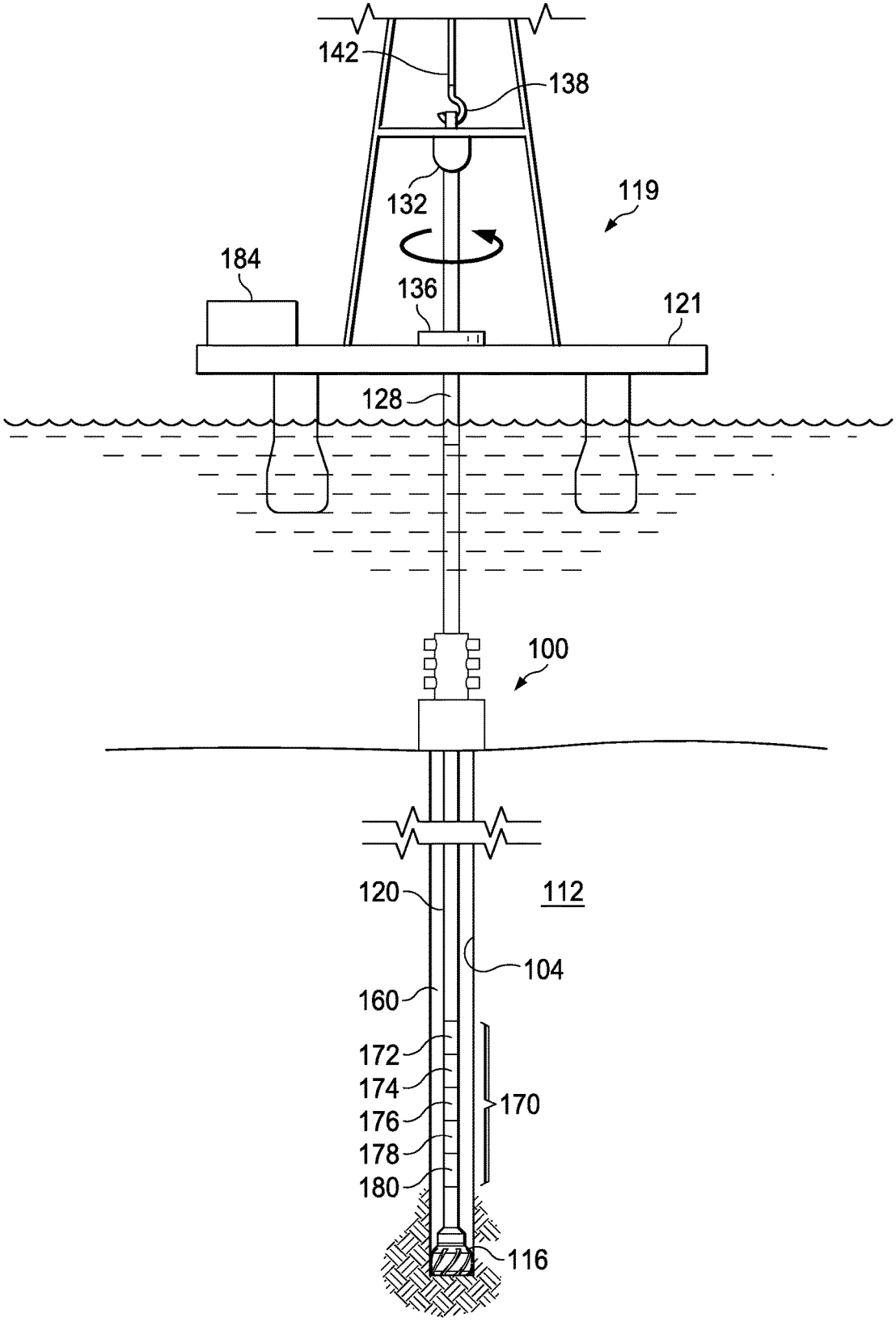
FIG. 1C illustrates a schematic view of a subsea well in which the formation sampling system of FIG. 1A is deployed.

Referring to FIGS. 1A-1C, a formation sampling system 100 according to an illustrative embodiment of the invention is used in a well 102 having a wellbore 104 that extends from a surface 108 of the well to or through a subterranean formation 112. The well 102 is illustrated onshore in FIG. 1A with the formation sampling system 100 being deployed in an LWD assembly 114. Alternatively, formation sampling system 100 may instead be deployed as part of a wireline assembly 115 (see FIG. 1B), either onshore or off-shore. The wireline assembly 115 includes a winch 117 to lift and lower a downhole portion of the wireline assembly 115 into the well. In still another embodiment, the formation sampling system 100 may be deployed in a sub-sea well 119 accessed by a fixed or floating platform 121. FIGS. 1A-1C each illustrate possible uses of the formation sampling system 100, and while the following description of the formation sampling system 100 focuses primarily on the use of the formation sampling system 100 with the LWD assembly 114 of FIG. 1A, the formation sampling system 100 may be used instead in the well configurations illustrated in FIGS. 1B and 1C, as well as in other well configurations where it is desired to sample a fluid. Similar components in FIGS. 1A-1C are identified with similar reference numerals.

In the embodiment illustrated in FIG. 1A, the well 102 is formed by a drilling process, in which a drill bit 116 is turned by a drill string 120 that extends from the drill bit 116 to the surface 108 of the well 102. The drill string 120 may be made up of one or more connected tubes or pipes, of varying or similar cross-section. The drill string may refer to the collection of pipes or tubes as a single component, or alternatively to the individual pipes or tubes that comprise the string. The term drill string is not meant to be limiting in nature and may refer to any component or components that are capable of transferring rotational energy from the surface of the well to the drill bit. In several embodiments, the drill string 120 may include a central passage disposed longitudinally in the drill string and capable of allowing fluid communication between the surface of the well and downhole locations.

At or near the surface 108 of the well, the drill string 120 may include or be coupled to a kelly 128. The kelly 128 may have a square, hexagonal or octagonal cross-section. The kelly 128 is connected at one end to the remainder of the drill string and at an opposite end to a rotary swivel 132. The kelly passes through a rotary table 136 that is capable of rotating the kelly and thus the remainder of the drill string 120 and drill bit 116. The rotary swivel 132 allows the kelly 128 to rotate without rotational motion being imparted to the rotary swivel 132. A hook 138, cable 142, traveling block (not shown), and hoist (not shown) are provided to lift or lower the drill bit 116, drill string 120, kelly 128 and rotary swivel 132. The kelly and swivel may be raised or lowered as needed to add additional sections of tubing to the drill string 120 as the drill bit 116 advances, or to remove sections of tubing from the drill string 120 if removal of the drill string 120 and drill bit 116 from the well 102 are desired.

A reservoir 144 is positioned at the surface 108 and holds drilling mud 148 for delivery to the well 102 during drilling operations. A supply line 152 is fluidly coupled between the reservoir 144 and the inner passage of the drill string 120. A pump 156 drives fluid through the supply line 152 and downhole to lubricate the drill bit 116 during drilling and to carry cuttings from the drilling process back to the surface 108. After traveling downhole, the drilling mud 148 returns to the surface 108 by way of an annulus 160 formed between the drill string 120 and the wellbore 104. At the surface 108, the drilling mud 148 is returned to the reservoir 144 through a return line 164. The drilling mud 148 may be filtered or otherwise processed prior to recirculation through the well 102.

During drilling, mud circulated through the well 102, which includes a liquid phase and a solid phase, may accumulate on the surface, or wall, of the wellbore 104 and in the case of the liquid phase may even permeate the wall into the formation. The penetration of the wellbore wall by portions of the drilling mud causes hydrocarbons in the formation, especially those near the wellbore, to become contaminated with drilling mud and any other contaminants that may exist within the well and circulated drilling mud. This contamination provides challenges to obtaining a "clean" or uncontaminated sample of hydrocarbons from the well.

A formation evaluation system 170 may be positioned downhole to measure, process, and communicate data regarding the physical properties of the formation or information about the drilling process or other operations occurring downhole. This information allows operators to make intelligent decisions about ongoing operation of the well. In some embodiments, the data measured and collected by the formation evaluation system 170 may include, without limitation, pressure, temperature, flow, acceleration (seismic and acoustic), and strain data. While the formation evaluation system 170 is illustrated as a part of the drill string 120 in FIG. 1A, in other embodiments, the formation evaluation system 170 may be lowered into the well by wireline (see FIG. 1B) either through the central passage of the drill string 120, or if the drill string 120 is not present, directly through the wellbore 104.

In some embodiments, the formation evaluation system 170 may include a plurality of tool components that are coupled to one another by threads, couplings, welds, or other means. In the illustrative embodiment depicted in FIG. 1A, the formation evaluation system 170 includes a transceiver unit 172, a power unit 174, a sensor unit 176, a pump unit 178, and a sample unit 180. Each of the individual components may include control electronics such as processor devices, memory devices, data storage devices, and communications devices, or alternatively a centralized control unit may be provided that communicates with and controls one or more of the individual components.

The transceiver unit 172 is capable of communicating with a surface controller 184 or similar equipment at or near the surface 108 of the well 102. Communication between the transceiver unit 172 and the surface controller 184 may be by wire if the drill string 120 is wired or if a wireline evaluation system is deployed. Alternatively, the transceiver unit 172 and surface controller 184 may communicate wirelessly using mud pulse telemetry, electromagnetic telemetry, or any other suitable communication method. Data transmitted by the transceiver unit 172 may include without limitation sensor data or other information measured by the various components of the formation evaluation system 170. The surface controller 184 may include processing devices, memory devices, data storage devices, communication devices, and user input/output devices. The surface controller 184 may communicate data to the transceiver unit 172 such as control data to direct the operation of the various components of the formation evaluation system 170.

The power unit 174 may be hydraulically powered by fluid circulated through the well or by fluid circulated or pressurized in a downhole, closed-loop hydraulic circuit. Alternatively, the power unit 174 may be an electrical power unit, an electro-mechanical power unit, a pneumatic power unit, or any other type of power unit that is capable of harnessing energy for transfer to powered devices. The power unit 174 may provide power to one or more of the components associated with the formation evaluation system 170, or alternatively to one or more other downhole devices. For example, in some embodiments, the power unit 174 may provide power to the pump unit 178. A pump associated with the pump unit 178 may be used to move fluids within or between the components of the formation evaluation system 170 as explained in more detail below. The sensor unit 176 may also receive power from the power unit 174 and may contain a number of sensors such as pressure sensors, temperature sensors, seismic sensors, acoustic sensors, strain gauges, inclinometers, or other sensors.

Figure 2:
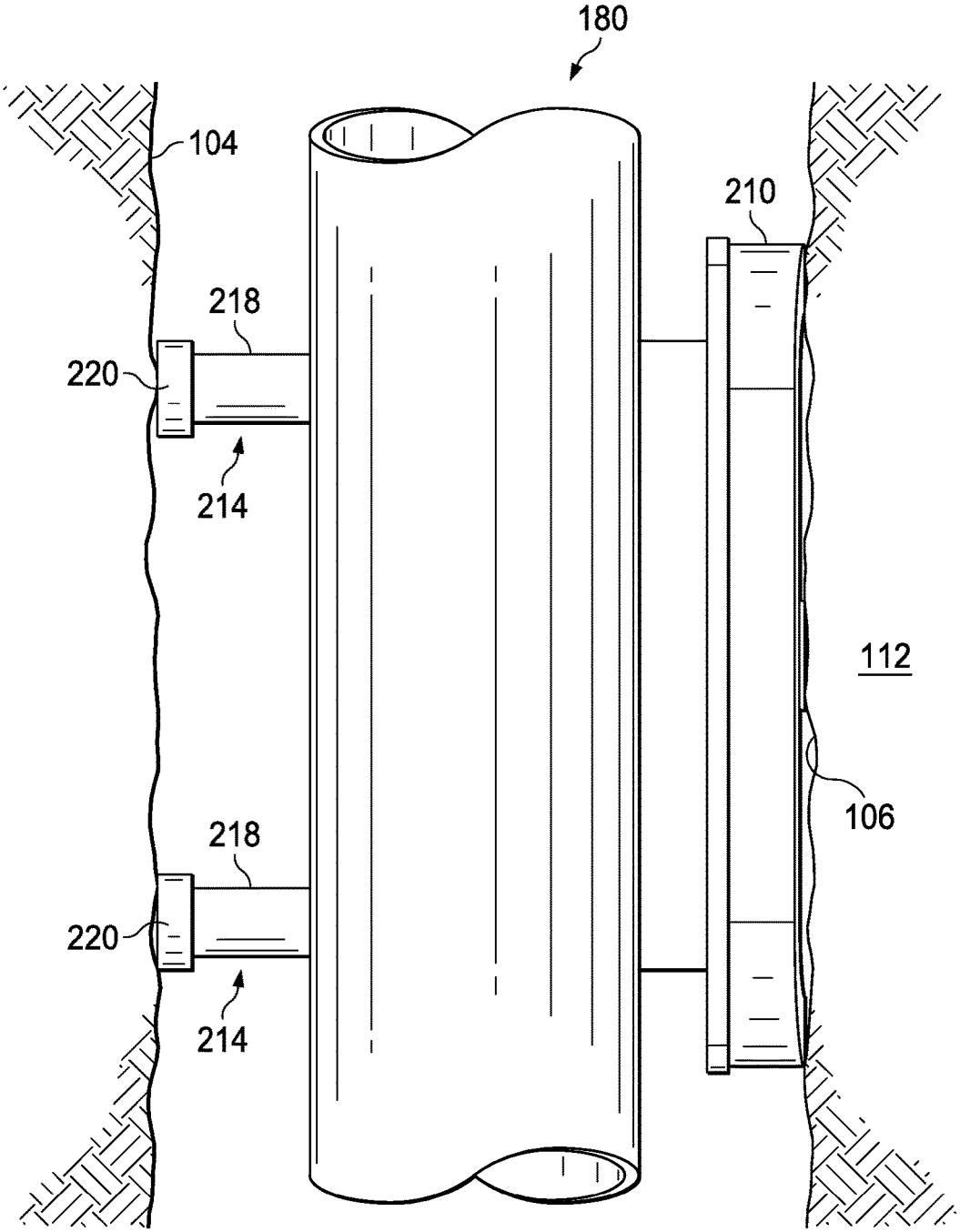
FIG. 2 depicts an enlarged schematic view of a sample unit having an extendable formation sample tool engaged against a surface of the wellbore.
Figure 3:
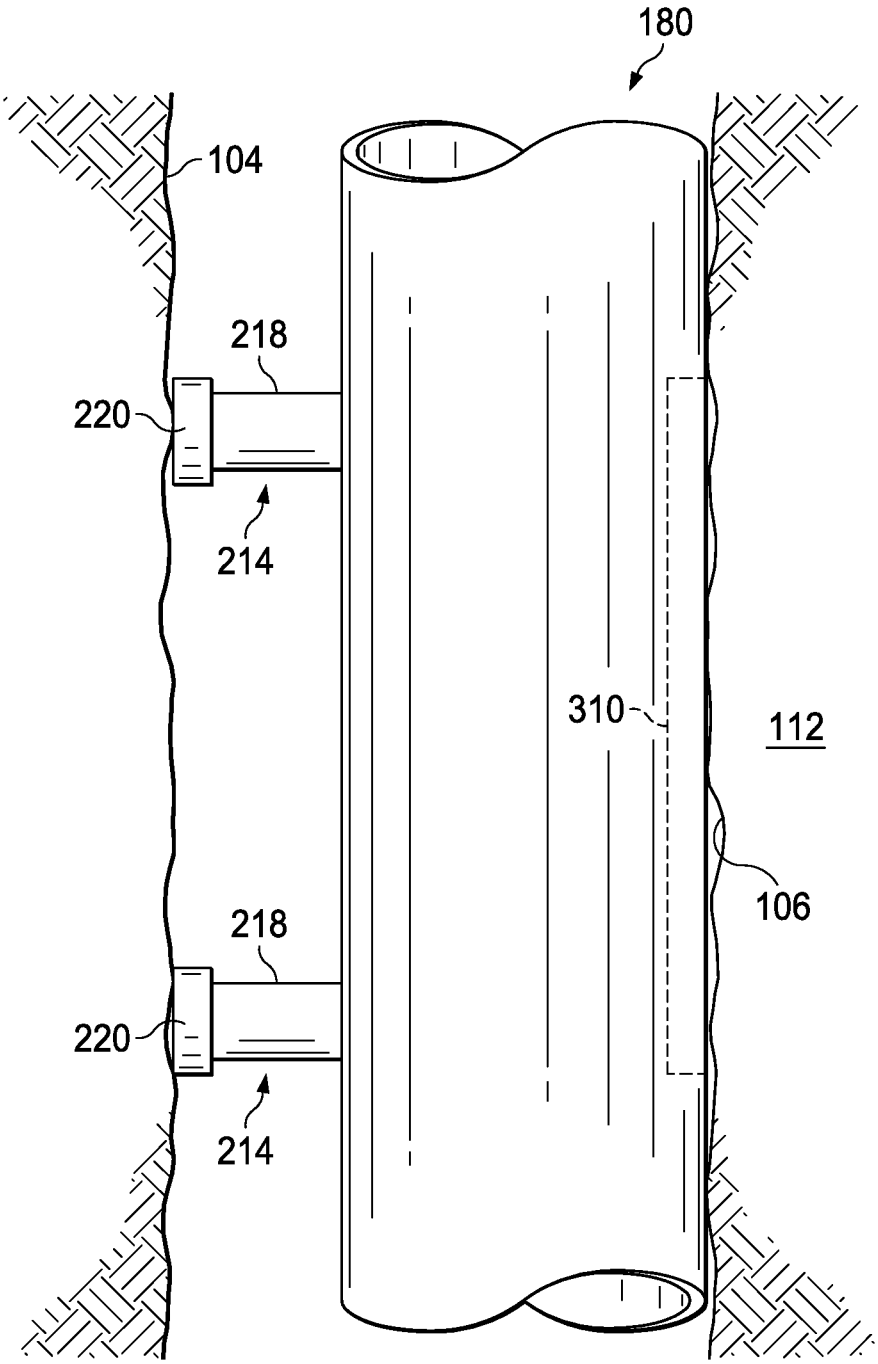
FIG. 3 illustrates an enlarged schematic view of a sample unit having a non-extendable formation sample tool that is engaged against a surface of the wellbore.

Referring still to FIG. 1A, but also to FIGS. 2 and 3, the sample unit 180 may include a formation sample tool 210 according to an illustrative embodiment of the present disclosure. In some embodiments such as that illustrated in FIG. 2, the formation sample tool 210 may be extendable from the sample unit 180, either hydraulically, pneumatically, mechanically, or in any other suitable manner. When not in use the formation sample tool 210 may be retracted either within the sample unit 180 or flush with an outside surface of the sample unit 180. One or more positioning members 214 may be extended from a side of the sample unit 180 opposite the formation sample tool 210. The positioning members 214 may include a base 218 coupled to feet 220 that are capable of engaging a surface 106 of the wellbore 104 when the positioning members 214 are extended. The positioning members 214 may hydraulically, pneumatically, mechanically, or otherwise extended from the sample unit 180 in a manner similar to that of the formation sample tool 210. As the positioning members 214 extend from the sample unit 180, the formation sample tool 210 is pressed into engagement with the surface 106 of the wellbore 104. In some embodiments, the force applied to the surface 106 of the wellbore 104 by the extendable formation sample tool 210 and positioning members 214 is sufficient to provide a sealing engagement between the formation sample tool 210 and the surface 106 of the wellbore 104.

Referring more specifically to FIG. 3, a non-extending embodiment of a formation sample tool 310 is illustrated. Similar in structure and function to formation sample tool 210, formation sample tool 310 differs in that the formation sample tool 310 does not extend from the sample unit 180. Instead, formation sample tool 310 is mounted approximately flush with the outer surface of the sample unit 180. Positioning members 214 may be used to press the formation sample tool 310 into engagement with the surface 106 of the wellbore 104.

Figure 4:
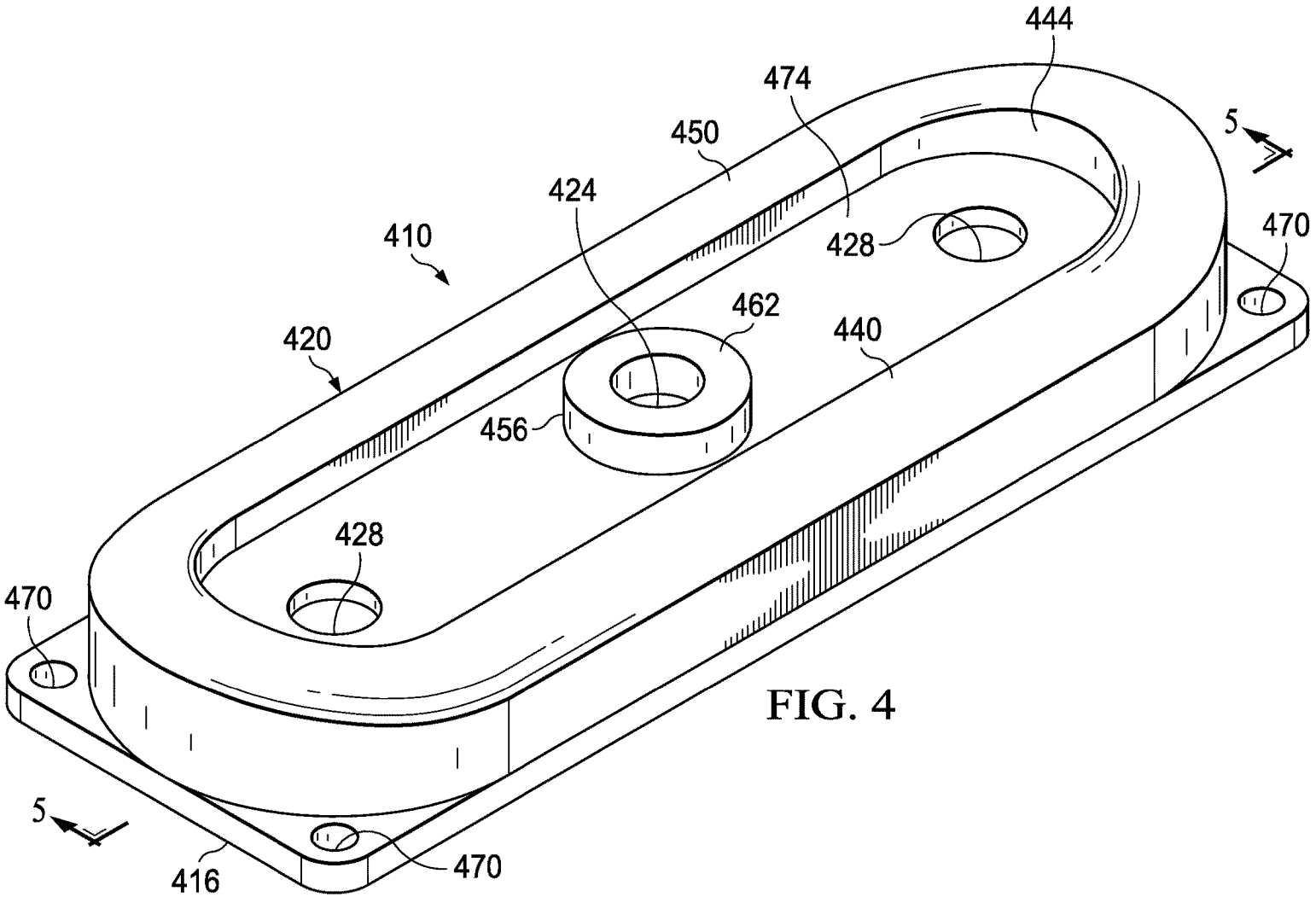
FIG. 4 depicts a front perspective view of a formation sample tool according to an embodiment of the present invention.

Referring now to FIG. 4, an illustrative embodiment of a formation sample tool 410 similar to the formation sample tools 210, 310 of FIGS. 2 and 3 is illustrated. The formation sample tool 410 includes a base, which in some embodiments may comprise a base plate 416, and a pad 420 coupled to the base plate 416. A first aperture or port 424, which in the embodiment of FIG. 4 is a centrally-located aperture, is disposed through the base plate 416 and the pad 420. At least one second aperture or port 428, which in the embodiment illustrated in FIG. 4 includes a pair of laterally-spaced apertures, is also disposed through both the base plate 416 and the pad 420. The pad 420 includes a raised shoulder 440 around its perimeter that surrounds a cavity 444. The cavity 444 is a recessed area of the pad 420 that fluidly communicates with at least one of the first and second apertures 424, 428.

The base plate 416 may be constructed from a variety of suitable materials, and in some embodiments the base plate 416 is metallic or another strong, yet fairly rigid material. The pad 420 may be constructed from an elastomeric material such as natural rubber, ethylene propylene diene monomer (EPDM), silicone polymers, or other elastomers. While an elastomeric material typically refers to a material having a low Young's modulus and a high yield strain compared to other materials, other non-elastomeric materials may be suitable for the pad 420 provided that the pad 420 is able to develop an adequate seal with the surface 106 of the wellbore 104 during use of the sample tool 410.

The shape of the sample tool 410 is generally elongated, and the pad 420 has an outer perimeter and an inner perimeter that are each generally oval in shape. Similarly, the cavity is 444 is generally oval in shape. While in some embodiments, the cavity 444 and the outer perimeter of the pad 420 are shaped similarly such as is illustrated in FIG. 4, in other embodiments the cavity 444 may have a different shape than the outer perimeter of the pad 420, thereby causing shoulder 440 to have a non-uniform width. While an oval shape for the pad 420 may be useful to allow the pad to better conform to the surface 106 of the wellbore 104, any other shape may be used for both the cavity and outer perimeter of the pad 420 provided that adequate sealing may be obtained. In some embodiments, a surface 450 of the shoulder 440 is substantially planar (i.e. flat). In other embodiments, the surface 450 may be non-planar and may include a contour to closely match the expected contour of the surface 106 of the wellbore 104. The size, shape, and contour of the pad 420 may vary depending upon the diameter and shape of the wellbore.

The pad 420 may include a sealing member 456 positioned around or surrounding the first aperture 424. The sealing member 456 is capable of providing a seal with the surface 106 of the wellbore 104 such that the first aperture 424 is fluidly isolated from the cavity 444 and the at least one second aperture 428. In some embodiments, a sealing surface 462 of the sealing member 456 is substantially co-planar with the surface 450 of the shoulder 440. In other embodiments, the sealing surface 462 might be slightly recessed relative to the surface 450 or may extend beyond the surface 450. The sealing surface 462 may be substantially planar or may in some embodiments include a contour to match the surface 106 of the wellbore 104. While the sealing member 456 is illustrated in FIG. 4 as a circular ring positioned around the first aperture 424, the sealing member 456 in some embodiments may be shaped differently. In the embodiment illustrated in FIG. 4, the sealing member 456 is sized and shaped to allow fluid communication within the cavity 444 completely around the sealing member 456. In other words, fluid communication is capable throughout the cavity 444 and between the laterally-spaced apertures (i.e. the at least one second aperture 428). In some embodiments, the sealing member 456 may be a part of the shoulder 440 that extends into the cavity 444 to isolate the first aperture 424.

The base plate 416 may include a plurality of mounting holes 470 that allow the formation sample tool 410 to be coupled to the sample unit 180. Alternatively, the formation sample tool 410 may be welded or attached by other means to the sample unit 180.

While referred to as apertures, the apertures 424, 428 are also aptly described as ports as well since they allow fluid communication between the cavity 444 and other components of the sample unit 180 to which the formation sample tool 410 is coupled. Described as either apertures or ports, the apertures may be either flush with a recessed surface 474 of the pad 420, or alternatively may have a raised surround or sealing member 456 such as the case with aperture 424. Although three apertures are illustrated in the embodiment of FIG. 4, fewer or greater numbers of apertures may be provided in the formation sample tool 410, and the positioning of the apertures may be varied. As explained in more detail below, it is desirable, however, in some embodiments, to have at least two apertures that are capable of being fluidly isolated from one another so that at least two different fluids may be delivered to the surface 106 of the wellbore 104 and to the formation. In other embodiments, a single aperture may be provided in the formation sample tool 410, and the at least two fluids may be delivered at different times through the same aperture.

Although the formation sample tool 410 has been illustrated with shoulder 440 and cavity 444, in some embodiments, it may be desirable to omit the cavity 444, instead providing a pad with a non-recessed surface (not illustrated) through which apertures are disposed. The non-recessed surface may be either planar or contoured (similar to the surface of the shoulder 440 described previously) and may be capable of sealing the pad and its associated apertures against the surface 106 of the wellbore 104.

Figure 5:
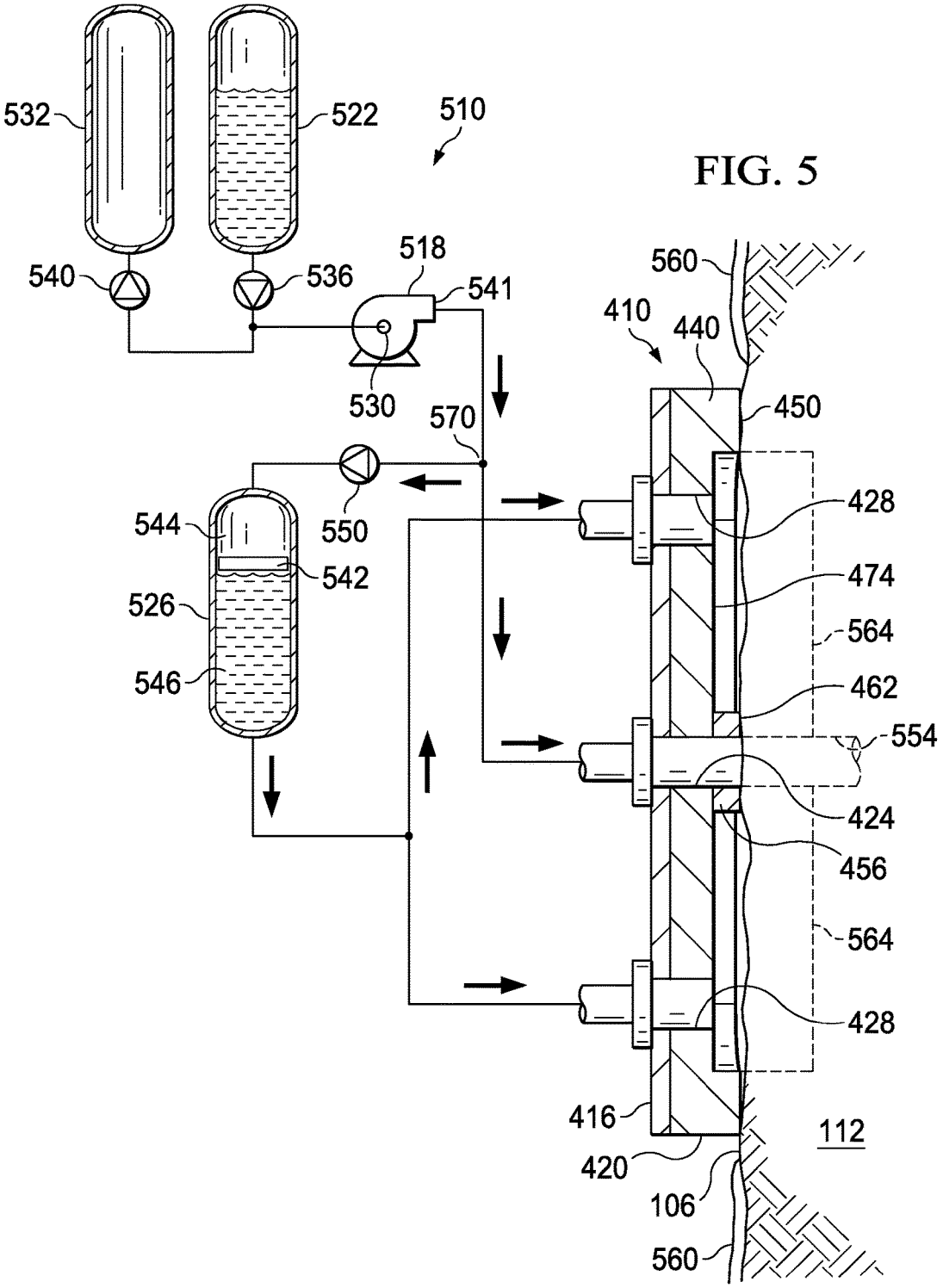
FIG. 5 illustrates a schematic view of a sample unit according to an illustrative embodiment of the invention in a preparation mode of operation, the sample unit including the formation sample tool of FIG. 4 engaged against a surface of the wellbore, the formation sample tool being shown in cross-section taken at 5-5.
Figure 6:
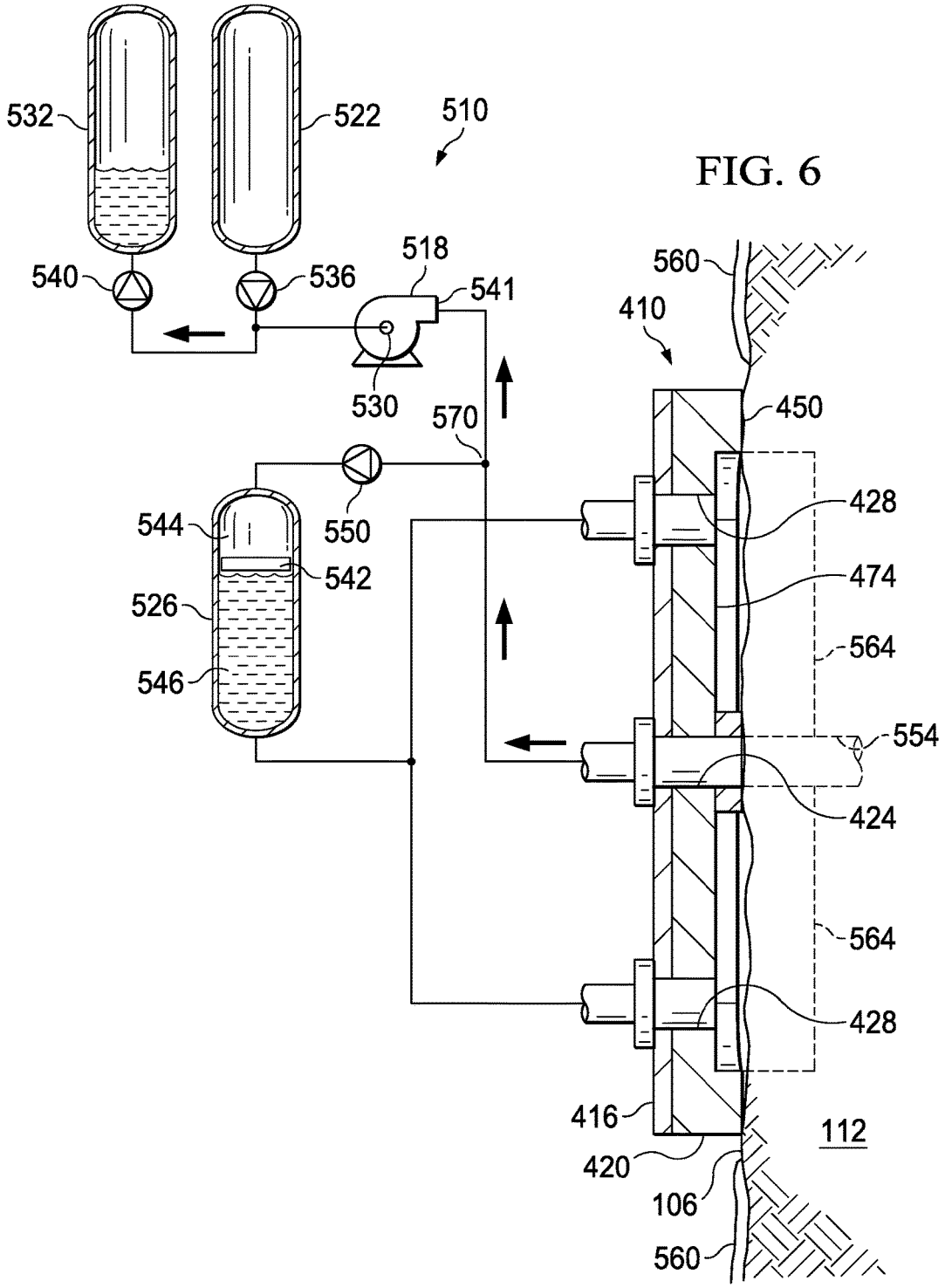
FIG. 6 depicts a schematic view of the sample unit of FIG. 5 in a sampling mode of operation.

Referring to FIGS. 5 and 6, an illustrative embodiment of a sample unit 510 includes formation sample tool 410 deployed against the surface 106 of wellbore 104. The sample unit 510 includes a pump 518, a first fluid source 522, and a second fluid source 526. While multiple alternatives exist for fluidly coupling the various components of sample unit 510, the pump 518 may be fluidly or hydraulically coupled to both the first fluid source 522 and the second fluid source 526. In FIG. 5, an inlet 530 of the pump 518 is fluidly coupled to the first fluid source 522. The inlet 530 of the pump 518 is also fluidly coupled to a sample tank 532 that is provided to store fluid samples obtained from the formation 112. A check valve 536 is provided between the pump 518 and the first fluid source 522 to ensure that fluid flows from the first fluid source 522 to the pump 518 and not the opposite direction. A check valve 540 is positioned between the pump 518 and the sample tank 532 to prevent fluid from flowing from the sample tank 532 to the pump 518.

An outlet 541 of the pump 518 is fluidly coupled to the first aperture or port 424 of the formation sample tool 410. The outlet 541 of the pump 518 is hydraulically coupled to the second fluid source 526. An outlet of the second fluid source 526 is fluidly coupled to the second apertures or ports 428 of the formation sample tool 410.

Both the first and second fluid sources 522, 526 may be tanks or other containers suitable to hold fluids (liquids or gases) prior to use of the fluids with the formation sample tool 410. The second fluid source 526 may include a piston 542 that separates a charging chamber 544 from a storage chamber 546. The charging chamber 544 is fluidly connected to the outlet of the pump 518 and is capable of being pressurized by the pump 518 when fluid from the first fluid source 522 is pumped to the charging chamber 544. As the charging chamber 544 is pressurized, the piston 542 is capable of exerting a force on any fluid in the storage chamber 546, thereby causing the fluid in the storage chamber 546 to flow toward the second apertures 428. A check valve 550 may be fluidly connected between the pump 518 and the charging chamber 544 to ensure flow only travels from the pump 518 toward the second fluid source 522.

In some embodiments the fluid contained in the first fluid source 522 (i.e., the first fluid) is water, an aqueous solution, or some other non-contaminating or non-gelling fluid. In FIG. 5, the connection of the first fluid source 522 to the first aperture 424 permits the first fluid to be directed into the formation 112 to create a pathway or sample passage 554 through which formation fluids may be collected and sampled. The use of non-contaminating or non-gelling fluid, such as for example water or an aqueous solution, prevents further contamination of fluids in the formation 112, which is more likely to ensure an uncontaminated sample is collected.

In some embodiments, the fluid contained in the second fluid source 526 (i.e., the second fluid) is a gellable or gelling composition. A gellable composition is one that is capable of undergoing a gelling or congealing process, typically in the presence of another substance, such as a gelling agent or a catalyst, or in the presence of some other stimuli. More specifically, the gellable composition is capable of assuming a higher viscosity when exposed to the gelling agent, catalyst, or stimuli. The gellable composition may instead be a fluid that causes other substances, such as for example hydrocarbons, to gel in the presence of the gellable composition. In some embodiments, the term "gel" or "congeal" refers to the process by which a material solidifies or coagulates. In its broadest sense used herein, a material gels or congeals by changing its material properties from a first flowable state to a second, less flowable state. In other words, in the second state, the material is less able to flow. In some embodiments described herein, the material in the second flowable state lacks flowability to the extent that the material is able to block or substantially restrict the flow of other more flowable substances, such as hydrocarbons. The material typically may be a liquid or other composition in the first state, and a gel or other "less flowable" liquid or composition in the second state. In some embodiments, the material in the second state may have transformed to a non-gel-like solid or firm material. Several examples of gellable compositions are described in more detail below, along with the use of gellable compositions with the systems and methods described herein.

The pump 518 may be capable of pumping fluid in either of two directions. In the first direction, the pump 518 may be capable of pumping fluid from the first fluid source 522 toward the formation and toward the charging chamber 544 of the second fluid source 526. In the second direction, the pump 518 may be capable of pumping formation fluid from the formation toward the sample tank 532. When the pump 518 is used to pump in the second direction, the inlet 530 (illustrated in FIG. 5) of the pump 518 may become the outlet of the pump 518 if the pump is electrically powered and the polarity of current provided to the pump 518 is reversed. Similarly, the direction of fluid flow may be reversed for non-electrically-powered pumps. Alternatively, the direction of fluid flow may be changed by associating a series of valves with the inlet and outlet of the pump 518 instead of reversing the direction of flow within the pump itself. Another alternative to reversing flow associated with the pump may include providing multiple pumps, and using at least one pump to move fluid in the first direction and at least one pump to move fluid in the second direction.

The various components of sample unit 510 may be positioned within the sample unit 510 itself, may be spread among other portions of the drill string or wireline, or may be positioned at the surface of the well. For example, the pump 518 may be positioned within a pump unit similar to the pump unit 178 (see FIG. 1A). In such an embodiment, the system would include appropriate fluid lines disposed between the pump unit and the sample unit. Alternative equipment may also be used in conjunction with the sampling of formation fluids. For example, instead of collecting formation fluid within sample tank 532, the formation fluid may instead be routed directly to sensors or other equipment that tests the fluid and directly relays the test results to the surface of the well. Such sensors or other equipment may be located within the sample unit 518, or within another part of the drill string or wireline such as the sensor unit 176. In some embodiments, the formation fluid collected from the formation 112 may be stored in the first fluid source 522 after the first fluid is depleted from the first fluid source 522. In such embodiments, the check valve 536 would be removed from the system.

FIG. 5 illustrates the sample unit 510 in a preparation mode of operation. In the preparation mode the first and second fluid sources 522, 526 contain first and second fluids, respectively. During this stage of the sampling process, the formation 112 is prepared so that an uncontaminated sample of formation fluid may be removed or collected from the formation in a sampling mode of operation (see FIG. 6). Prior to the formation sample tool 410 being applied to the surface 106 of the wellbore 104, a mudcake layer 560 and other contaminants that line the wellbore may be removed. Multiple options are possible for cleaning the wall or surface 106 of the wellbore. For example, a cleansing solution, which may include water, an aqueous solution, or a chemical solvent, may be directed under pressure at the wall of the wellbore 104 prior to seating the formation sample tool 410. If water is used to clean the area where the formation sample tool 410 is to be applied, it may be directed through one or more of the apertures 424, 428. The water or aqueous solution may be provided by first fluid source 522. Alternatively, a separate cleansing fluid source (not illustrated) may be provided to assist in clearing the mudcake layer 560 from a desired sample location. In another example, mechanical devices, such as retractable blades or brushes may be applied to the surface 106 of the wellbore 104 to physically remove the mudcake layer 560. Following removal of the mudcake layer 560, the formation sample tool 410 may be applied to the surface 106 of the wellbore 104 with a force sufficient enough to seal the surface 450 of the shoulder 440 against the surface 106 of the wellbore 104 to prevent or substantially reduce fluid communication between the cavity 444 and the wellbore 104. Similarly, the sealing surface 462 of the sealing member 456 seals against the surface 106 of the wellbore 104 to prevent direct fluid communication between the cavity 444 and the first aperture 424.

Referring still to FIG. 5, the first and second fluids may be delivered to the formation either simultaneously or sequentially. For simultaneous deployment of the fluids, the pump 518 is activated and the first fluid enters the pump 518 from the first fluid source 522. The first fluid is driven by the pump 518 both to the first aperture 424 and the charging chamber 544 of the second fluid source 526. At the second fluid source 526, the charging chamber 544 is pressurized by the first fluid, and the piston 542 drives the second fluid from the storage chamber 546 to the second apertures 428. Simultaneously, or almost simultaneously the first fluid and the second fluid reach the surface 106 of the wellbore 104. In some embodiments such as the one illustrated in FIG. 5, the first fluid is not allowed to dissipate into the cavity 444 because of the presence of sealing member 456. Instead, the first fluid is forced into the permeable formation and "cleans" an area represented by pathway, or sample passage 554. The first fluid sweeps through this pathway 554 and pushes contaminated hydrocarbons or other formation fluids from the pathway 554. The first fluid may also open a more direct and less restrictive fluid pathway to deeper areas of the formation, areas in which the hydrocarbons or other formation fluids are not contaminated by mud and other contaminants. As the pathway 554 is being established by the first fluid, the second fluid enters the cavity 444 and the formation beneath the cavity 444 and surrounding the pathway 554. The area of the formation which the second fluid enters is represented by a protected zone 564 in FIG. 5. As the second fluid enters the formation and contacts hydrocarbons or other formation fluids, either the second fluid gels, or the hydrocarbons or other formation fluids gel. This gelling of fluids serves as a barrier to contaminants and contaminated formation fluids entering the pathway 554. By blocking the pathway 554 from areas of the formation that may contain contaminants, the formation sample tool 410 is able to remove or obtain an uncontaminated sample of formation fluid.

In some embodiments, the first and second fluids may be injected at different times (i.e., sequentially) as opposed to simultaneously. For sequential deployment of the fluids using the formation sample tool 410 illustrated in FIG. 5, the pump 518 is activated and the first fluid enters the pump 518 from the first fluid source 522. One or more valves (not shown) may be provided to control the path of the first fluid after leaving the pump 518. For example, a three-way valve (not illustrated) may be positioned at junction 570 to direct the first fluid to either the first aperture 424 or to the charging chamber 544 depending on which of the first and second fluid is to be delivered to the formation first. If the first fluid is to be delivered first, the three-way valve is positioned to direct the first fluid directly to the first aperture 424. Following the clearing of the pathway 554 with the first fluid, the three-way valve may be repositioned to direct the first fluid to the charging chamber 544, which in turn delivers the second fluid to the second apertures 428. In some embodiments, it may instead be desired to deliver the second fluid to the formation first and then the first fluid. Again, this procedure may be varied by use of a three-way valve or other valving configurations.

In some embodiments, the sequential delivery of the first and second fluids may be accomplished through one or more of the same apertures or ports associated with the formation sample tool. For example, an alternatively designed formation sample tool may include one or more ports, each of which are fluidly connected to both the first and second fluid sources 522, 526. In such a configuration, the first and second fluids may be sequentially delivered to the formation, followed by withdrawal of formation fluid through the same one or more ports.

Referring now to FIG. 6, the sampling mode of operation is illustrated. Following deployment of the formation sample tool 410 and establishment of the pathway 554 and protected zone 564, a sample of formation fluid may be removed or collected from the formation. If formation pressures are sufficiently high, formation fluid may be collected in the sample tank 532 without the use of the pump 518. If the pump 518 is needed to draw the formation fluid from the formation, the direction of fluid flow associated with the pump may be reversed relative to that illustrated in FIG. 5. In FIG. 6, the inlet 530 of the pump 518 is reversed from that illustrated in FIG. 5. Similarly, the outlet 541 of the pump 518 is reversed. As explained previously, other suitable methods are available to allow reversal of flow with a single pump system, or alternatively, multiple pumps may be employed.

When the pump 518 is activated, formation fluid may be drawn from the formation through the first aperture 424 and delivered to the sample tank 532. Check valve 536 prevents the formation fluid from being delivered to the first fluid source 522. In some embodiments, the formation fluid may be tested prior to storing it in sample tank 532 to ensure that the sample is uncontaminated. Provisions may also be made to divert contaminated fluid to the wellbore 104 if detected. In still other embodiments, it is possible that formation fluid is not stored, but rather tested using an in-line testing system that records data regarding properties of sampled formation fluid.

Figure 7:
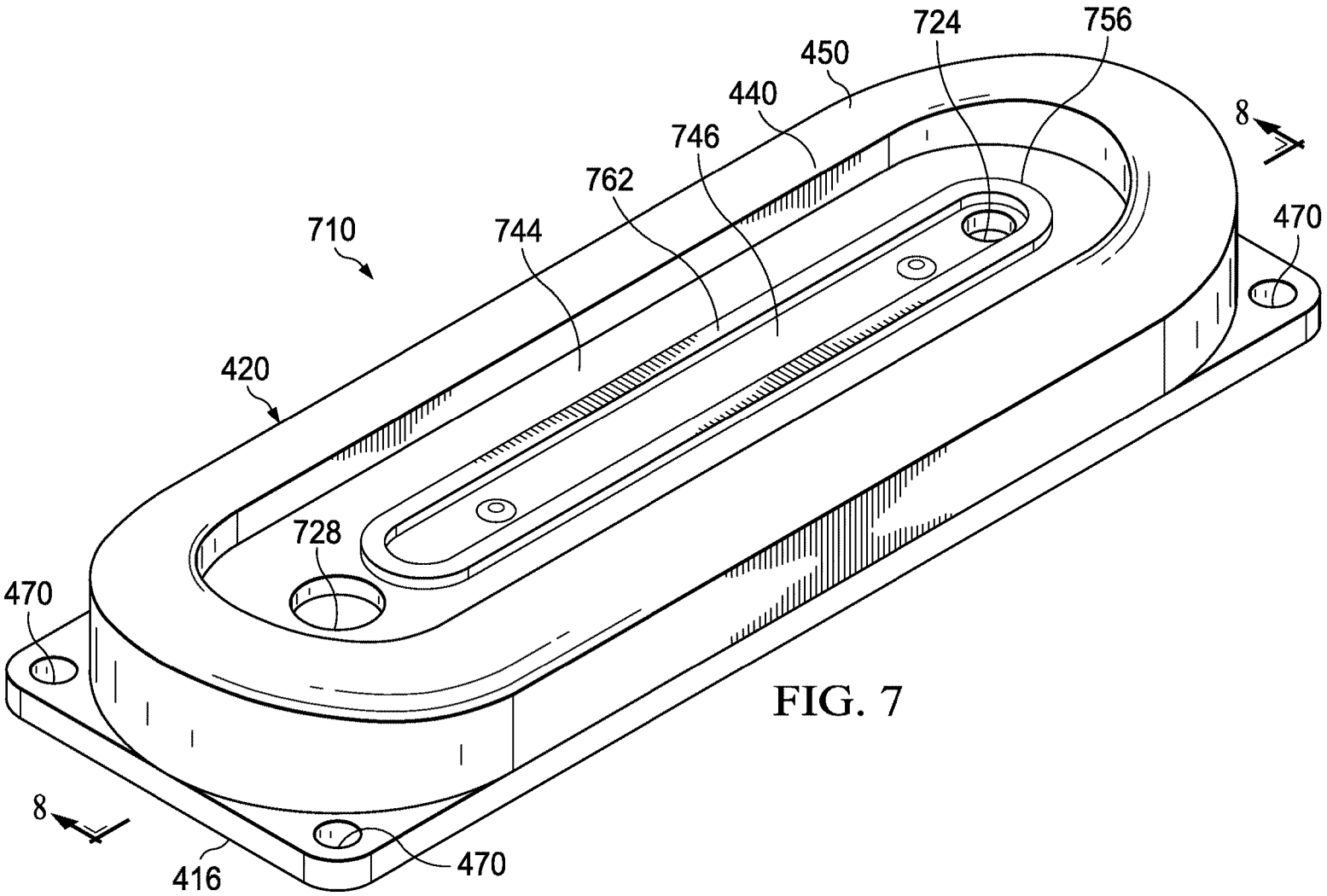
FIG. 7 illustrates a front perspective view of a formation sample tool according to an embodiment of the present invention.

Referring now to FIG. 7, an illustrative embodiment of a formation sample tool 710 similar to the formation sample tools 210, 310, 410 of FIGS. 2-4 is illustrated. The formation sample tool 710 includes multiple components in common with formation sample tool 410, and similar components have been labeled with the same reference numerals as those previously described with reference to FIG. 4. Differences between the formation sample tool 710 and formation sample tool 410 include the placement and configuration of the apertures passing through the formation sample tool 710. Formation sample tool 710 includes a first aperture or port 724 and a second aperture or port 728, both apertures 724, 728 passing through the base plate 416 and the pad 420. While the front aperture 724 is smaller in diameter than the second aperture 728, in another embodiment, the apertures 724, 728 may be equal in size, or the first aperture 724 may be the larger of the apertures. The second aperture 728 is positioned at or near a first end of the pad 420 within a first cavity 744 defined by the raised shoulder 440 of the pad 420. The first aperture 724 is positioned at or near a second end of the pad 420 within a second cavity 746 defined by a sealing member 756. The first cavity 744 and the second cavity 746 are recessed areas relative to the surface 450 of the raised shoulder 440 and a sealing surface 762 of the sealing member 756, respectively. In some embodiments, the surface 450 and the sealing surface 762 are substantially planar, and the surface 450 and the sealing surface 762 may in some instances be co-planar.

The base plate 416 and pad 420 may be constructed from any suitable materials, including those previously mentioned with reference to formation sample tool 410 of FIG. 4. As previously described, the shape of the base plate 416 and the pad 420 may be generally elongated, and the pad 420 is illustrated in FIG. 7 as having an outer perimeter and an inner perimeter that are each generally oval in shape. Similarly, the first cavity is 744 is generally oval in shape. While in some embodiments, the first cavity 744 and the outer perimeter of the pad 420 are shaped similarly such as is illustrated in FIG. 7, in other embodiments the first cavity 744 may have a different shape than the outer perimeter of the pad 420, thereby causing shoulder 440 to have a non-uniform width. While an oval shape for the pad 420 may be useful to allow the pad to better conform to the surface 106 of the wellbore 104, any other shape may be used for both the cavity and outer perimeter of the pad 420 provided that adequate sealing may be obtained. The size, shape, and contour of the pad 420 may vary depending upon the diameter and shape of the wellbore.

The sealing member 756 surrounds the first aperture 724 and is capable of providing a seal with the surface 106 of the wellbore 104 such that the first aperture 724 and the second cavity 746 are fluidly isolated from the first cavity 744 and the second aperture 728. As described above, while the sealing surface 762 of the sealing member 756 may be substantially co-planar with the surface 450 of the shoulder 440, in other embodiments, the sealing surface 762 may be slightly recessed relative to the surface 450 or may extend beyond the surface 450. The sealing surface 762 may be substantially planar or may in some embodiments include a contour to match the surface 106 of the wellbore 104. The sealing member 756 in FIG. 7 is illustrated as a generally oval ring positioned around the first aperture 724 but within the first cavity 744. The sealing member 756 in this embodiment is sized and shaped to allow fluid communication within the first cavity 744 completely around the sealing member 756. In other words, fluid communication is capable throughout the first cavity 744 around an outside perimeter of the sealing member 756.

Although only two apertures are illustrated in the embodiment of FIG. 7, fewer or greater numbers of apertures may be provided in the formation sample tool 710, and the positioning of the apertures may be varied. As explained herein, it is desirable, however, in some embodiments, to have at least two apertures that are capable of being fluidly isolated from one another so that at least two different fluids may be delivered to the formation at different locations. As an alternative to the aperture configuration illustrated in FIG. 7, multiple apertures could be included in either or both of first cavity 744 and second cavity 746.

Although the formation sample tool 710 is illustrated in FIG. 7 with first cavity 744 and second cavity 746, in some embodiments, it may be desirable to omit the first or second cavities 744, 746, or both, and instead provide a pad with a non-recessed surface (not illustrated) through which apertures are disposed. The non-recessed surface may be either planar or contoured (similar to the surface 450 of the shoulder 440 described previously) and may be capable of sealing the pad and its associated apertures against the surface 106 of the wellbore 104.

Figure 8:
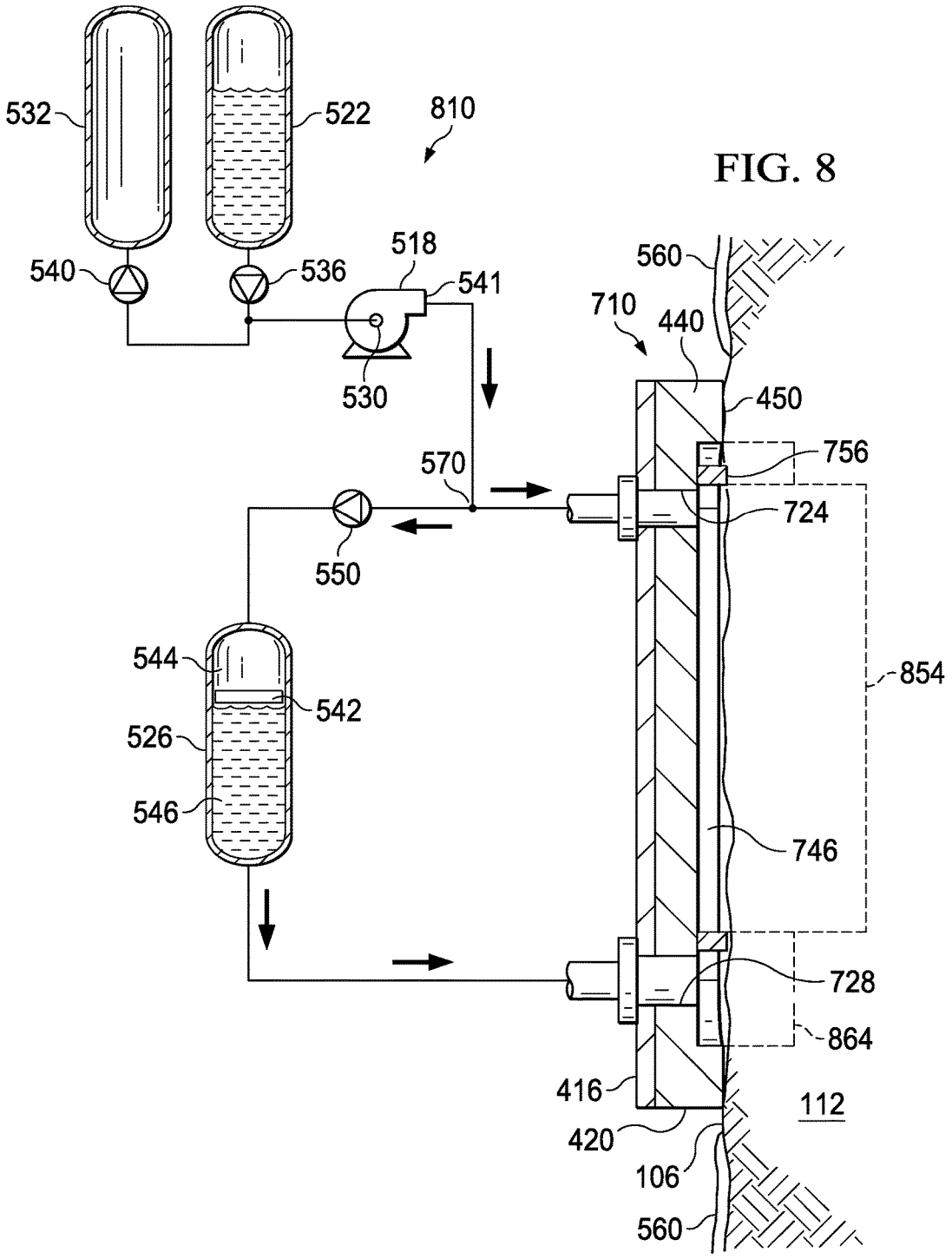
FIG. 8 depicts a schematic view of a sample unit according to an illustrative embodiment of the invention in a preparation mode of operation, the sample unit including the formation sample tool of FIG. 7 engaged against a surface of the wellbore, the formation sample tool being shown in cross-section taken at 8-8.

Referring to FIG. 8, an illustrative embodiment of a sample unit 810 includes formation sample tool 710 deployed against the surface 106 of wellbore 104. The sample unit 810 includes multiple components in common with sample unit 510 of FIG. 5, and similar components are labeled with the same reference numerals as those previously described with reference to FIG. 5. Differences between the sample unit 810 and sample unit 510 include the fluid communication configuration associated with the apertures 724, 728. In sample unit 810, first aperture 724 is fluidly connected to first fluid source 522 and second aperture 728 is fluidly connected to second fluid source 526. While multiple alternatives exist for fluidly coupling the various components of sample unit 810, the pump 518 may be fluidly or hydraulically coupled to both the first fluid source 522 and the second fluid source 526. In FIG. 8, the inlet 530 of the pump 518 is fluidly coupled to the first fluid source 522. The inlet 530 of the pump 518 is also fluidly coupled to the sample tank 532 that is provided to store fluid samples obtained from the formation 112. The outlet 541 of the pump 518 is fluidly coupled to the first aperture 724 of the formation sample tool 710. The outlet 541 of the pump 518 is hydraulically coupled to the second fluid source 526. The outlet of the second fluid source 526 is fluidly coupled to the second aperture 728 of the formation sample tool 710.

FIG. 8 illustrates the sample unit 810 in a preparation mode of operation. In the preparation mode the first and second fluid sources 522, 526 contain first and second fluids, respectively. During this stage of the sampling process, the formation 112 is prepared so that an uncontaminated sample of formation fluid may be removed or collected from the formation in a sampling mode of operation. Prior to the formation sample tool 710 being applied to the surface 106 of the wellbore 104, the mudcake layer 560 and other contaminants that line the wellbore may be removed in a manner similar to that previously described. Following removal of the mudcake layer 560, the formation sample tool 710 may be applied to the surface 106 of the wellbore 104 with a force sufficient enough to seal the surface 450 of the shoulder 440 against the surface 106 of the wellbore 104 to prevent or substantially reduce fluid communication between the first cavity 744 and the wellbore 104. Similarly, the sealing member 756 seals against the surface 106 of the wellbore 104 to prevent direct fluid communication between the first cavity 744 and the first aperture 724.

Referring still to FIG. 8, the first and second fluids may be delivered to the formation either simultaneously or sequentially. For simultaneous deployment of the fluids, the pump 518 is activated and the first fluid enters the pump 518 from the first fluid source 522. The first fluid is driven by the pump 518 both to the first aperture 724 and the charging chamber 544 of the second fluid source 526. At the second fluid source 526, the charging chamber 544 is pressurized by the first fluid, and the piston 542 drives the second fluid from the storage chamber 546 to the second aperture 728. Simultaneously, or almost simultaneously the first fluid and the second fluid reach the surface 106 of the wellbore 104. In some embodiments such as the one illustrated in FIG. 8, the first fluid is not allowed to dissipate into the first cavity 744 because of the presence of sealing member 756. Instead, the first fluid is forced through the second cavity 746 and into the permeable formation to "clean" an area represented by pathway, or sample passage 854. The first fluid sweeps through this pathway 854 and pushes contaminated hydrocarbons or other formation fluids from the pathway 854. The first fluid may also open a more direct and less restrictive fluid pathway to deeper areas of the formation, areas in which the hydrocarbons or other formation fluids are not contaminated by mud and other contaminants. As the pathway 854 is being established by the first fluid, the second fluid enters the first cavity 744 and the formation beneath the first cavity 744 and surrounding the pathway 854. The area of the formation which the second fluid enters is represented by a protected zone 864 in FIG. 8. As the second fluid enters the formation and contacts hydrocarbons or other formation fluids, either the second fluid gels, or the hydrocarbons or other formation fluids gel. This gelling of fluids serves as a barrier to contaminants and contaminated formation fluids entering the pathway 854. By blocking the pathway 854 from areas of the formation that may contain contaminants, the formation sample tool 710 is able to remove or obtain an uncontaminated sample of formation fluid.

In some embodiments, the first and second fluids may be injected at different times (i.e., sequentially) as opposed to simultaneously. For sequential deployment of the fluids using the formation sample tool 710 illustrated in FIG. 8, the pump 518 is activated and the first fluid enters the pump 518 from the first fluid source 522. One or more valves (not shown) may be provided to control the path of the first fluid after leaving the pump 518. For example, a three-way valve (not illustrated) may be positioned at junction 570 to direct the first fluid to either the first aperture 724 or to the charging chamber 544 depending on which of the first and second fluid is to be delivered to the formation first. If the first fluid is to be delivered first, the three-way valve is positioned to direct the first fluid directly to the first aperture 724. Following the clearing of the pathway 854 with the first fluid, the three-way valve may be repositioned to direct the first fluid to the charging chamber 544, which in turn delivers the second fluid to the second aperture 728. In some embodiments, it may instead be desired to deliver the second fluid to the formation first and then the first fluid. Again, this procedure may be varied by use of a three-way valve or other valving configurations.

Following the preparation mode of operation and the clearing of sample passage 854, samples of uncontaminated formation fluid may be collected or removed through the sample passage 854 in a manner similar to the sampling mode of operation described in FIG. 6.

Figure 9:
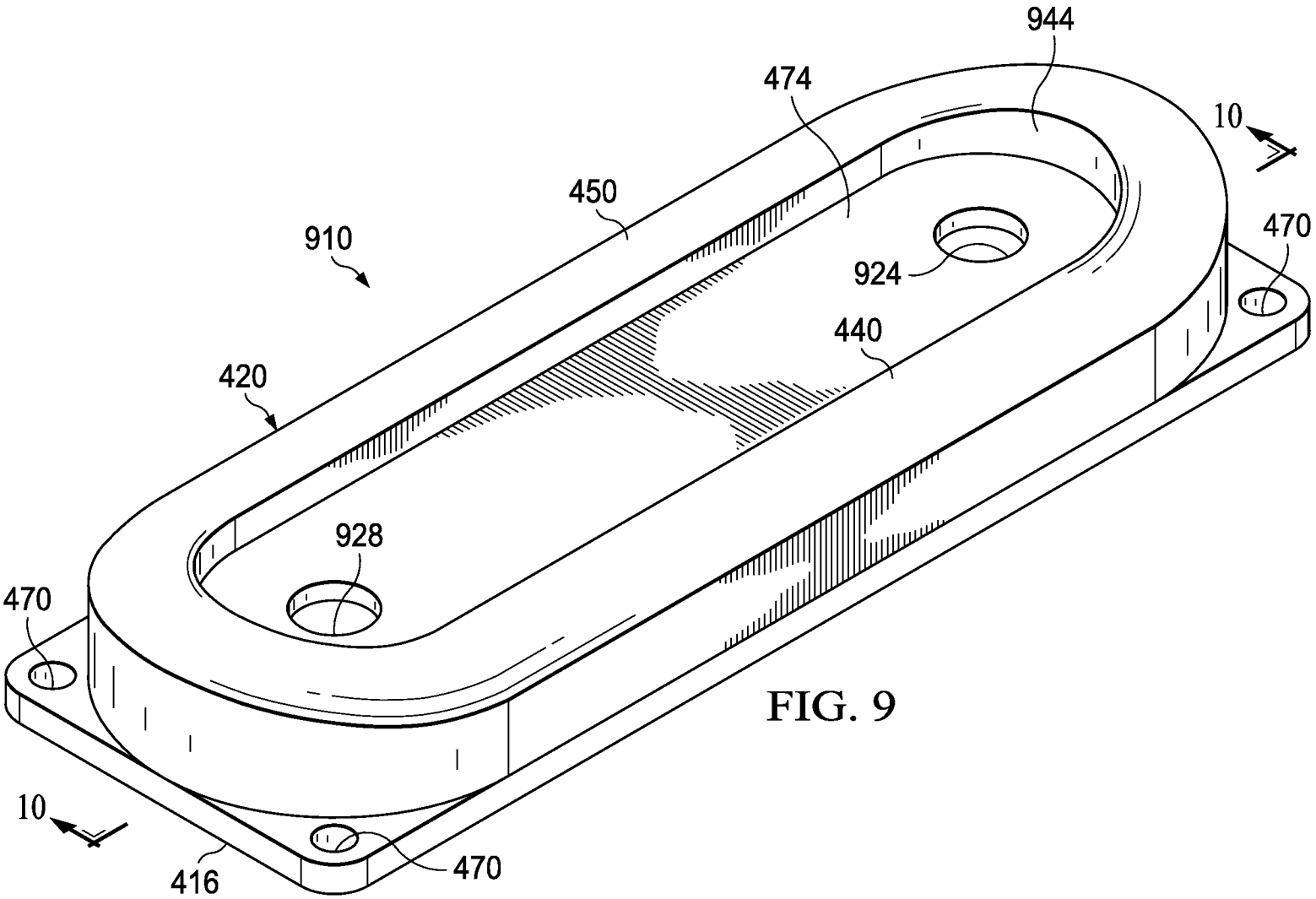
FIG. 9 illustrates a front perspective view of a formation sample tool according to an embodiment of the present invention.

Referring now to FIG. 9, an illustrative embodiment of a formation sample tool 910 similar to the formation sample tools 210, 310, 410, 710 of FIGS. 2-4 and 7 is illustrated. The formation sample tool 910 includes multiple components in common with formation sample tool 410, and similar components have been labeled with the same reference numerals as those previously described with reference to FIG. 4. Differences between the formation sample tool 910 and formation sample tool 410 include the placement and configuration of the apertures passing through the formation sample tool 910. Formation sample tool 910 includes a first aperture or port 924 and a second aperture or port 928, both apertures 924, 928 passing through the base plate 416 and the pad 420. The second aperture 928 is positioned at or near a first end of the pad 420 within a cavity 944 defined by the raised shoulder 440 of the pad 420. The first aperture 924 is positioned at or near a second end of the pad 420 also within the cavity 944. The cavity 944 is recessed relative to the surface 450 of the raised shoulder 440.

The base plate 416 and pad 420 may be constructed from any suitable materials, including those previously mentioned with reference to formation sample tool 410 of FIG. 4. As previously described, the shape of the base plate 416 and the pad 420 may be generally elongated, and the pad 420 is illustrated in FIG. 9 as having an outer perimeter and an inner perimeter that are each generally oval in shape. Similarly, the cavity 944 is generally oval in shape. While in some embodiments, the cavity 944 and the outer perimeter of the pad 420 are shaped similarly such as is illustrated in FIG. 9, in other embodiments the cavity 944 may have a different shape than the outer perimeter of the pad 420, thereby causing shoulder 440 to have a non-uniform width. While an oval shape for the pad 420 may be useful to allow the pad to better conform to the surface 106 of the wellbore 104, any other shape may be used for both the cavity and outer perimeter of the pad 420 provided that adequate sealing may be obtained. The size, shape, and contour of the pad 420 may vary depending upon the diameter and shape of the wellbore.

Although only two apertures are illustrated in the embodiment of FIG. 9, fewer or greater numbers of apertures may be provided in the formation sample tool 910, and the positioning of the apertures may be varied. As explained herein, it is desirable, however, in some embodiments, to have at least two apertures such that at least two different fluids may be delivered through formation sample tool 910 to different areas of the formation.

Although the formation sample tool 910 is illustrated in FIG. 9 with cavity 944, in some embodiments, it may be desirable to omit the cavity 944 and instead provide a pad with a non-recessed surface (not illustrated) through which apertures are disposed. The non-recessed surface may be either planar or contoured (similar to the surface 450 of the shoulder 440 described previously) and may be capable of sealing the pad and its associated apertures against the surface 106 of the wellbore 104.

The formation sample tool 910 of FIG. 9 also differs from other formation sample tools described herein since a sealing member is not provided to fluidly isolate the first aperture 924 from the second aperture 928. As will be described in more detail with reference to FIG. 10, this particular configuration of formation sample tool 910 is particularly useful when the formation is divided into more than one zone by a demarcation boundary.

Figure 10:
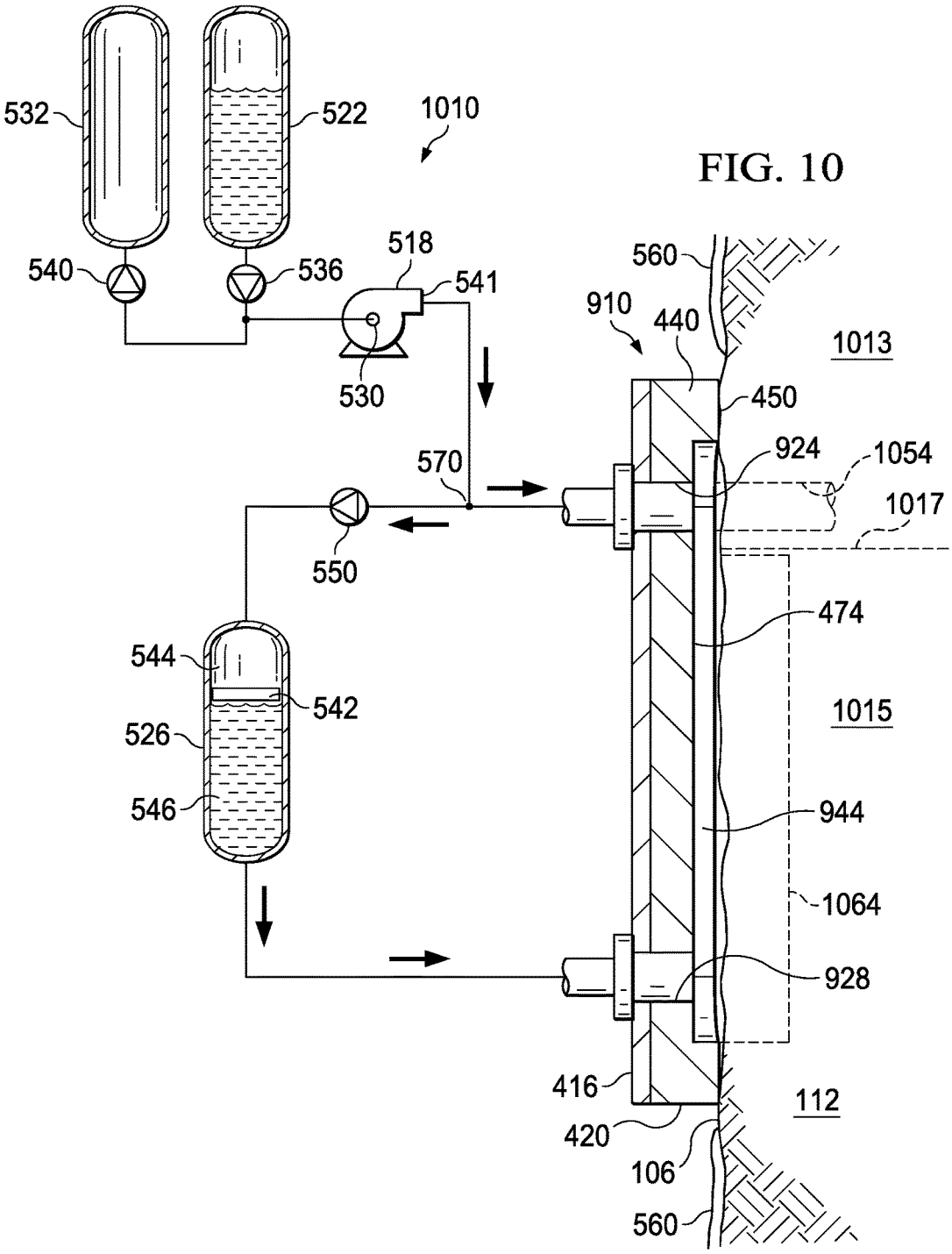
FIG. 10 depicts a schematic view of a sample unit according to an illustrative embodiment of the invention in a preparation mode of operation, the sample unit including the formation sample tool of FIG. 9 engaged against a surface of the wellbore, the formation sample tool being shown in cross-section taken at 10-10.

Referring to FIG. 10, an illustrative embodiment of a sample unit 1010 includes formation sample tool 910 deployed against the surface 106 of wellbore 104. The sample unit 1010 includes multiple components in common with sample unit 510 of FIG. 5, and similar components are labeled with the same reference numerals as those previously described with reference to FIG. 5. Differences between the sample unit 1010 and sample unit 510 include the fluid communication configuration associated with the apertures 924, 928. In sample unit 1010, first aperture 924 is fluidly connected to first fluid source 522 and second aperture 928 is fluidly connected to second fluid source 526. While multiple alternatives exist for fluidly coupling the various components of sample unit 1010, the pump 518 may be fluidly or hydraulically coupled to both the first fluid source 522 and the second fluid source 526. In FIG. 10, the inlet 530 of the pump 518 is fluidly coupled to the first fluid source 522. The inlet 530 of the pump 518 is also fluidly coupled to the sample tank 532 that is provided to store fluid samples obtained from the formation 112. The outlet 541 of the pump 518 is fluidly coupled to the first aperture 924 of the formation sample tool 910. The outlet 541 of the pump 518 is hydraulically coupled to the second fluid source 526. The outlet of the second fluid source 526 is fluidly coupled to the second aperture 928 of the formation sample tool 910.

FIG. 10 illustrates the sample unit 1010 in a preparation mode of operation. The formation of 112 illustrated in FIG. 10 includes an upper zone 1013 and a lower zone 1015 separated by a demarcation boundary 1017. In some instances involving dual-zone or multi-zone formations, it is desirous to reduce flow from one particular zone while obtaining samples from the other zone.

In the preparation mode illustrated in FIG. 10, the first and second fluid sources 522, 526 contain first and second fluids, respectively. During this stage of the sampling process, the formation 112 is prepared so that an uncontaminated sample of formation fluid may be removed or collected from the formation in a sampling mode of operation. Prior to the formation sample tool 910 being applied to the surface 106 of the wellbore 104, the mudcake layer 560 and other contaminants that line the wellbore may be removed in a manner similar to that previously described. Following removal of the mudcake layer 560, the formation sample tool 910 may be applied to the surface 106 of the wellbore 104 with a force sufficient enough to seal the surface 450 of the shoulder 440 against the surface 106 of the wellbore 104 to prevent or substantially reduce fluid communication between the cavity 944 and the wellbore 104. The positioning of the formation sample tool 910 in the wellbore 104 is such that first aperture 924 is proximate the upper zone 1013 and the second aperture 928 is proximate the lower zone 1015. The demarcation boundary 1017, which is substantially horizontal in the embodiment illustrated in FIG. 10, is positioned between the first and second apertures 924, 928.

The first and second fluids may be delivered to the formation either simultaneously or sequentially. For simultaneous deployment of the fluids, the pump 518 is activated and the first fluid enters the pump 518 from the first fluid source 522. The first fluid is driven by the pump 518 both to the first aperture 924 and the charging chamber 544 of the second fluid source 526. At the second fluid source 526, the charging chamber 544 is pressurized by the first fluid, and the piston 542 drives the second fluid from the storage chamber 546 to the second aperture 928. Simultaneously, or almost simultaneously the first fluid and the second fluid reach the surface 106 of the wellbore 104. The first fluid is forced into the upper zone 1013 of the formation 112 to "clean" an area represented by pathway, or sample passage 1054. The first fluid sweeps through this pathway 1054 and pushes contaminated hydrocarbons or other formation fluids from the pathway 1054. The first fluid may also open a more direct and less restrictive fluid pathway to deeper areas of the formation, areas in which the hydrocarbons or other formation fluids are not contaminated by mud and other contaminants. As the pathway 1054 is being established by the first fluid, the second fluid enters the lower zone 1015 of the formation 112. The area of the formation which the second fluid enters is represented by a protected zone 1064 in FIG. 10. As the second fluid enters the formation and contacts hydrocarbons or other formation fluids, either the second fluid gels, or the hydrocarbons or other formation fluids gel. This gelling of fluids serves as a barrier to contaminants and contaminated formation fluids exiting the lower zone 1015 of the formation 112 and entering the pathway 1054. By blocking the pathway 1054 from areas of the formation that may contain contaminants, the formation sample tool 910 is able to remove or obtain an uncontaminated sample of formation fluid.

In some embodiments, the first and second fluids may be injected at different times (i.e., sequentially) as opposed to simultaneously. For sequential deployment of the fluids using the formation sample tool 910 illustrated in FIG. 10, the pump 518 is activated and the first fluid enters the pump 518 from the first fluid source 522. One or more valves (not shown) may be provided to control the path of the first fluid after leaving the pump 518. For example, a three-way valve (not illustrated) may be positioned at junction 590 to direct the first fluid to either the first aperture 924 or to the charging chamber 544 depending on which of the first and second fluid is to be delivered to the formation first. If the first fluid is to be delivered first, the three-way valve is positioned to direct the first fluid directly to the first aperture 924. Following the clearing of the pathway 1054 with the first fluid, the three-way valve may be repositioned to direct the first fluid to the charging chamber 544, which in turn delivers the second fluid to the second aperture 928. In some embodiments, it may instead be desired to deliver the second fluid to the formation first and then the first fluid. Again, this procedure may be varied by use of a three-way valve or other valving configurations.

Following the preparation mode of operation and the clearing of sample passage 1054, samples of uncontaminated formation fluid may be collected or removed through the sample passage 1054 in a manner similar to the sampling mode of operation described in FIG. 6.

Various suitable compositions may be provided to serve as the second fluid described herein. The hydrocarbon content of the formation in the areas surrounding the sample passages 554, 854, 1054 may be gelled or made less flowable by injecting a hydrocarbon gelling (or gellable) composition while injecting a non-gelling fluid or an activator solution for the hydrocarbon gelling composition into the sample passages 554, 854, 1054. The gelled hydrocarbon in the zones surrounding the sample passages 554, 854, 1054 allows for focusing of the drawdown pressure to facilitate collection of uncontaminated formation fluids. The oil gelling compositions may comprise an organophosphate ester or diester and metal salts such as aluminum (III) or iron (III) or any polyvalent metal ion salts that are complexed with an organic amine in an oxygenated solvent such as, for example, acetone, an alcoholic solvent or an alcohol ether solvent which is not viscosified by the gelling composition. The activator composition may be comprised of alkali metal hydroxide or carbonate dissolved in water or water/alcohol or water acetone mixture. A suitable activator is an inorganic salt that can hydrolyze the organophosphate ester to generate a carboxylate salt with carbon chain length of C6-C18 chain length. The metal ion will react with the carboxylate to form oil-soluble complex cross-linked structures that can viscosify a hydrocarbon fluid.

Alternatively, the oil gelling composition may be injected into the sample passages 554, 854, 1054, while the activator solution for the hydrocarbon gelling composition is injected into the surrounding area (in FIGS. 5, 6, 8, and 10, this procedure for blocking contaminated hydrocarbons from the sample passages 554, 854, 1054 would likely entail filling the first fluid source 522 with the oil gelling composition and the second fluid source 526 with the activator solution). The injection pressure into the sample passages 554, 854, 1054 is maintained higher than that into the surrounding zone to prevent significant intermingling of the activator and gelling compositions inside sample passages 554, 854, 1054. Compositions for gelling hydrocarbons are described in U.S. Pat. Nos. 5,271,474; 5,514,645; 6,147,034; 7,328,744; and 8,119,575, each of which is hereby incorporated by reference. Such compositions are commercially available as My-T-Oil™ products from Halliburton Energy Services.

Alternatively, hydrocarbons may also be gelled by block polymers comprising a hydrophobic polymer block and a hydrophilic polymer block. Such polymers may be dissolved or dispersed in a polar solvent mixture such as an aqueous fluid or a non-polar fluid such as hydrocarbons. A water/organic solvent mixture such as water/tetrahydrofuran or water/ethylene-glycol butyl ether mixture can be used as a carrier fluid for the polymers to inject into the zone surrounding the sample passages 554, 854, 1054, while simultaneously injecting an aqueous fluid without the polymer into the sample passages 554, 854, 1054. The polymer will migrate from the aqueous fluid phase into the hydrocarbon phase of the formation and viscosify the hydrocarbon phase, while the sample passages 554, 854, 1054 remain free of any such gelled formation fluid. Compositions of suitable polymers are described in U.S. Pat. No. 4,448,916, which is hereby incorporated by reference.

In some embodiments, preventing or reducing the entry of contaminated hydrocarbons into the sample passage may be accomplished not by the interaction of a gelling composition and a hydrocarbon, but rather by the use of a multi-component gellable or gelling composition comprising 1) a gellable component and 2) a gel-time-controlling agent mixed or contacted within the formation or prior to delivery to the formation to form a gelled portion with a higher viscosity and an ungelled portion of lower viscosity. Alternatively, the gellable composition may comprise a gellable component that upon contact with the gel-time-controlling agent forms a gel of higher viscosity in the contacted region. Various possible combinations exist, and may include without limitation a) a gellable component comprising cross-linkable polymers and a gel-time-controlling agent comprising a crosslinking agent; 2) a gellable component comprising an alkali metal silicate or aluminate solution and a gel-time-controlling agent comprising a divalent metal ion solution such as calcium or magnesium ions, or a pH lowering agent, such as an organic ester, a sugar or a polyphosphate salt; or 3) a gellable component comprising a monomer solution (for example, acrylamide, hydroxyethyl acrylate, acrylate salts, AMPS and the like) and a gel-time-controlling agent comprising a polymerization initiator (for example, persulfate salts, organic peroxides and hydroperoxide, and water soluble azo compounds). Examples of cross-linkable polymers include polyacrylamides, polyvinyl alcohols, partially hydrolyzed polyacrylamides, or other suitable copolymers of acrylamides and acrylates, or biopolymers such as guar gums and its derivatives, carboxymethyl celluloses and the like. Suitable gel-time-controlling agents for such polymers include metal ions such as chromium (III), Fe(III), Al(III), Zirconium (IV), titanium (IV), or non-metallic anions such as borate ions or polymers, including for example borax, or polymeric cross-linkers such as polyethylenimine. In some embodiments, the gel-time-controlling agent may be injected into a portion of the formation first, followed by the gellable component. In other embodiments, both fluids are injected simultaneously into adjacent portions of a formation in sufficient proximity to make fluid contact. In general, any gelling composition that can block flow of unwanted fluids from the formation into the wellbore when present in the porosity of the fluid flow path can be adapted with suitable modification in the described embodiments. Examples of such gellable compositions employed for preventing flow of formation water into a wellbore are reviewed in a paper—"Chemical Water & Gas Shutoff Technology—An Overview", published in the proceedings of Society of Petroleum Engineers Asia Pacific Improved Oil Recovery Conference Meeting held in Kuala Lumpur, Malasia during 8-9 Oct. 2001 as SPE 72119. This document is incorporated herein by reference.

In some embodiments, the gellable component has a predefined gel time, and the gel-time-controlling agent comprises a component that retards/extends the gel time of the gellable composition in the areas of contact or comprises a gelation inhibitor which prevents gelation of the gellable composition in the areas of contact. Suitable examples of gellable compositions include 1) a combination of a cross-linkable polymer with a suitable cross-linker such as those mentioned above, 2) a combination of polymerizable monomers and polymerization initiators such as those mentioned above and alkali metal silicates or aluminates and pH lowering agents such as those described above. Examples of gel time extenders or gelation inhibitors include alkalis or high pH fluids to inhibit gelation of silicate/aluminates, or crosslinking reactions of polymers with cross-linkers. Examples of gel time inhibitors or gelation inhibitors for polymerization of organic monomers include radical polymerization inhibitors such as hydroquinones, phenols and copper salts and the like. In some embodiments the gelation inhibitor or gel time retarder is injected simultaneously or sequentially into regions in which the sample passages or flow paths need to remain unblocked and permeable, and the gellable component is injected simultaneously or following the injection of gel time inhibitor or retarder.

Even though only a few specific examples are provided for the systems that may be employed to prevent or reduce contaminated hydrocarbons from migrating into the sample passage, any combination of chemicals or compositions that form products of viscosity different than that of the initial components is suitable for use with the systems and methods described herein.

It should be apparent from the foregoing that an invention having significant advantages has been provided. While the invention is shown in only a few of its forms, it is not limited to only these embodiments but is susceptible to various changes and modifications without departing from the spirit thereof.

We claim:

1. A method for collecting uncontaminated formation fluid from a wellbore through the formation for testing, the method comprising:

introducing a formation sample tool into the wellbore, the formation sample tool having a first port and a second port;

injecting a first fluid through the first port into the formation to clear a sample passage within the formation of contaminants and allowing access to uncontaminated formation fluid;

injecting a second fluid through the second port into the formation to provide a barrier adjacent to or around and less deep than the sample passage, wherein the barrier serves as a barrier to contaminants from the wellbore and contaminated formation fluids entering the sample passage;

collecting a sample of the uncontaminated formation fluid from the formation through the sample passage from beyond the barrier and through the first port.

2. The method of claim 1, wherein the second fluid causes gelling of a hydrocarbon upon contact with the hydrocarbon or an activator solution.

3. The method of claim 1, wherein the second fluid forms a gel of higher viscosity than the first fluid without requiring contact with a hydrocarbon.

4. A system for collecting uncontaminated formation fluid from a wellbore through the formation for testing, the system comprising:

a formation sample tool positionable within the wellbore, the formation sample tool having a first aperture and a second aperture, the first aperture and second aperture being positionable in fluid communication with the formation;

a first fluid source in fluid communication with the first aperture;

a second fluid source in fluid communication with the second aperture;

a pump fluidly or hydraulically coupled to both the first fluid source and the second fluid source to inject a fluid from the first fluid source and a fluid from the second fluid source into the formation; and wherein uncontaminated formation fluid is collectable through the at least one aperture.

5. The system of claim 4 wherein the pump is operable to collect formation fluid from the formation.

6. The system of claim 4, wherein the formation sample tool further comprises:

a pad having a raised shoulder extending around a perimeter of the pad, the shoulder having a surface adapted to contact a surface of the wellbore, the shoulder further defining a cavity associated with the pad;

wherein the first and second apertures extend through the pad.

7. The system of claim 6, wherein the formation sample tool further comprises:

a sealing member positioned around the first aperture, the sealing member having a sealing surface configured to contact the surface of the wellbore, wherein the sealing surface of the sealing member and the surface of the shoulder are substantially co-planar, and wherein the sealing surface of the sealing member, when engaged with the surface of the wellbore, fluidly isolates the first aperture from the cavity.

8. The system of claim 6, wherein the formation sample tool further comprises a base plate coupled to the pad, wherein the at least one aperture extend through the base plate.

9. The system of claim 4, wherein the formation sample tool further comprises:

a base; and a pad coupled to the base, the pad having a raised shoulder with a surface adapted to contact a surface of the wellbore;

wherein the second aperture includes a pair of laterally-spaced apertures; and wherein the first aperture is positioned between the pair of laterally-spaced apertures.

10. The system of claim 9, wherein the formation sample tool further comprises:

a sealing member positioned around the first aperture, the sealing member having a sealing surface adapted to contact the surface of the wellbore.

11. The system of claim 9, wherein the formation sample tool further comprises:

a sealing member positioned around the first aperture, the sealing member having a sealing surface adapted to contact the surface of the wellbore;

wherein the raised shoulder of the pad defines a cavity;

wherein the sealing member fluidly isolates the first aperture from the cavity when the sealing surface of the sealing member is in contact with the surface of the wellbore.

12. The system of claim 11, wherein:

the sealing member is a circular ring; and both of the pair of laterally-spaced apertures are in fluid communication with the cavity when the surface of the raised shoulder is in contact with the surface of the wellbore.

13. The system of claim 4, wherein the formation sample tool further comprises:

a base;

a pad coupled to the base, the pad having a raised shoulder with a surface adapted to contact a surface of the wellbore, the raised shoulder of the pad defining a first cavity; and a sealing member defining a second cavity, the sealing member having a sealing surface adapted to contact the surface of the wellbore;

wherein the first aperture fluidly communicates with the second cavity;

wherein the second aperture fluidly communicates with the first cavity.

14. The system of claim 13, wherein:

the first aperture is fluidly isolated from the first cavity;

the second aperture is fluidly isolated from the second cavity.

15. The system of claim 13, wherein the sealing member, the first cavity, or both, are oval in shape, and wherein the sealing member is disposed within the first cavity such that first cavity surrounds the sealing member.

16. The system of claim 13, wherein:

the second aperture is disposed at a first end of the pad within the first cavity; and the first aperture is disposed at a second and opposite end of the pad within the second cavity.

17. The system of claim 13, wherein:

a diameter of the second aperture is greater than a diameter of the first aperture.

18. The system of claim 13, wherein the first and second apertures each pass through both the base and the pad.

* * * * *